US011825931B2

(12) United States Patent
Chung et al.

(10) Patent No.: US 11,825,931 B2
(45) Date of Patent: Nov. 28, 2023

(54) LIP ACTIVATED CUP

(71) Applicant: JMBH Holdings, LLC, Shelton, CT (US)

(72) Inventors: Andrew Chung, Shelton, CT (US); Patrick Thrailkill, Shelton, CT (US); Robert F. Rosasco, III, Shelton, CT (US)

(73) Assignee: JMBH HOLDINGS, LLC, Shelton, CT (US)

( * ) Notice: Subject to any disclaimer, the term of this patent is extended or adjusted under 35 U.S.C. 154(b) by 0 days.

(21) Appl. No.: 17/701,235

(22) Filed: Mar. 22, 2022

(65) Prior Publication Data

US 2022/0279914 A1 Sep. 8, 2022

Related U.S. Application Data

(63) Continuation of application No. 16/772,091, filed as application No. PCT/US2018/044341 on Jul. 30, 2018, now Pat. No. 11,311,094.

(Continued)

(51) Int. Cl.
*A45F 3/16* (2006.01)
*A47G 19/22* (2006.01)

(52) U.S. Cl.
CPC ..... *A45F 3/16* (2013.01); *A47G 19/2272* (2013.01)

(58) Field of Classification Search
CPC ... A45F 3/16; A47G 19/2272; A47G 19/2266; B65D 41/04; B65D 51/18; B65D 2251/0015; B65D 2543/00046

(Continued)

(56) References Cited

U.S. PATENT DOCUMENTS 6,732,878 B2 5/2004 Gillen
8,272,525 B1 9/2012 La Torre (Continued)

FOREIGN PATENT DOCUMENTS

EP 3381333 A1 10/2018
WO PCT/US2018/044341 6/2019

OTHER PUBLICATIONS

International Search Report and Written Opinion issued in Corresponding PCT Application No. PCT/US2018/044341, dated Dec. 14, 2018.

*Primary Examiner* — Robert J Hicks
(74) *Attorney, Agent, or Firm* — GETZ BALICH LLC

(57) ABSTRACT

A cup (12) or container assembly (10) having a lip (13, 15) activated input feature. The lip (13, 15) activated feature permits removal of the contents from the cup (12) or container (12) while mitigating against leaks and/or spills. The lid (12, 14) includes a movable member (48, 58) and a baffle (54, 59). The cup assembly (10) is constructed to have streamlined assembly method due to a reduced number of parts needing separation and/or improved connecting features. The improved geometry of lid (12, 14) components lends to heightened ease of cleaning. A cup (12) or container assembly (10) having a lip (13, 15) activated input feature. The lip (13, 15) activated feature permits removal of the contents from the cup (12) or container (12) while mitigating against leaks and/or spills. The lid (12, 14) includes a movable member (48, 58) and a baffle (54, 59). The cup assembly (10) is constructed to have streamlined assembly method due to a reduced number of parts needing separation and/or improved connecting features. The improved geometry of lid (12, 14) components lends to heightened ease of cleaning.

16 Claims, 13 Drawing Sheets

Related U.S. Application Data

(60) Provisional application No. 62/597,137, filed on Dec. 11, 2017.

(58) Field of Classification Search
USPC ..... 220/288, 254.7, 254.1, 714, 713, 711, 220/345.4, 345.1, 259.5, 256.1
See application file for complete search history.

(56) References Cited

U.S. PATENT DOCUMENTS

| | | | |
|---|---|---|---|
| 9,504,342 | B2 | 11/2016 | Chan |
| 10,881,228 | B2 | 1/2021 | Miller |
| 11,311,094 | B2 | 4/2022 | Chung et al. |
| 2009/0212061 | A1 | 8/2009 | Naesje |

LIP ACTIVATED CUP

CROSS-REFERENCE TO RELATED APPLICATIONS

This application is a continuation of U.S. application Ser. No. 16/772,091, filed Jun. 11, 2020, which is a national phase application under 35 U.S.C. § 371 of International Application No. PCT/US2018/044341, filed Jul. 30, 2018, which claims priority to U.S. Provisional Patent Application Ser. No. 62/597,137, filed Dec. 11, 2017, the contents of which applications are incorporated by reference herein.

BACKGROUND OF THE INVENTION

A. Field of Endeavor

The present disclosure relates to cups and infant or children feeding containers. More particularly, the present invention relates to infant cup assemblies and/or infant or child feeding container assemblies.

B. Background Information

Child cups seek to conform to the needs of a child and/or a caretaker. Child cups having handles, cups with spouts or straws, and cups that mitigate against fluid escaping the container other than by the spout or straw are known.

Cups have graphics, colors and/or shapes designed to appeal to a child and/or a caretaker.

It is desirous to have not only a cup assembly and/or container assembly that mitigates against leaks, but also suits the feeding needs of the child, and/or the use or habits of the caretaker, while appealing to the child and optionally assisting the child in his or her development.

SUMMARY

The present disclosure provides a lip activated cup assembly. The term "container assembly" as used herein is inclusive of vessels and containers used by children and/or infants for feeding or activities related to feeding, such as food containers and liquid containers, as well as their related parts. Similarly, the term "container" is inclusive of vessels and containers used by children and/or infants for feeding or activities related to feeding, such as food containers and liquid containers. The cups and containers include a connection means (press-fit, snap-fit interference fit, detent connection, latch, threads, helical threads, bayonet tracks, male/female connection, hybrids thereof, etc.) securing the lid to the cup or container. The lip activated cup or container permits withdrawal of the contents. The child exerts a force on a movable member which deflects and permits fluid to bypass the movable member. The movable member is biased to be in a closed state, such that, upon release of the force of the child's lip, the movable member creates a seal and mitigates against spills in the event the cup is tipped over. In this manner, the lip activated cup utilizes pressure exerted by the user's lip against a movable member. When the pressure is exerted, the movable member permits fluid to flow through a baffle and thereby enables the user to drink. The pressure exerted by the lip is useful in helping young children (1) progress from drinking from nipples and sippy cups to (2) drinking from an open rim cup, while mitigating against spills and/or leaks. In other words, the child has learned to apply suction from a rounded structure such as a nipple, spout or straw, and the cup assembly of the present disclosure transitions the child to use of suction force to a more elongate shape such as the rim (or lip) of a cup, such that the child learns the proper lip positioning to learn to sip from an open-rim cup. Furthermore, such a cup can be tipped like an open-rim cup to reinforce how to get the fluid to the rim of the cup to be consumed. As the user removes her lip from the movable member, the movable member returns to its initial position thereby preventing fluid from flowing out of the baffle.

Another aspect of the present disclosure resides in a simplified cup having two components-a lid and a cup. The lid and/or cup may, individually, include many non-integral parts, but the cup in of this configuration is designed to reduce assembly or cleaning complexity such that it is easy to use (particularly while providing care for one or more children). In some embodiments, there is a single lid component and a single cup component. In other embodiments, the lid includes two pieces. In yet other embodiments, the lid includes three pieces. In yet further embodiments, a handle is included that is integral with or attached to either the lid or the cup.

Some prior art cups have blind openings or crevices, particularly at the connection points between the movable member and baffle, that cannot be easily and properly cleaned; it requires disassembling at least two lid components that can be difficult to separate and/or properly reassemble. The cup of the present disclosure alleviates this by having a structure without small (or blind) recesses that are difficult to access. Additionally, current lip activated include a four-piece assembly—a collar that secures the lid assembly to the cup, a movable member, a baffle, and a connecting piece. The present disclosure teaches to embodiments with less than a four-piece assembly. In current lip activated cups, the assembly can prove difficult to assembly or reassemble given it is unclear what the orientation of certain parts (example, the baffle) is. Incorrect assembly due to ambiguity in the design leads to cups that either (a) don't activate properly when a user's lip depresses the movable member, or it causes leaks when the cup is tipped-over. In other words, a reduced number of total parts and parts having a distinct top-side and bottom-side will assist in streamlined assembly. Parts having a clear mating feature to another party only on one side of the part reduces confusion during assembly.

In some embodiments, the movable member and baffle is a single piece made of a thermoplastic material with a Shore A durometer of about 30 to about 70. The single piece lid has varying thickness to achieve various functions, albeit, a sturdy upper lip feature and a sturdy baffle is preferable, meaning small variations in thickness (in contrast to suction/deflection cups where the movable member outer periphery is thereby thinner than other portions of the lid). Nonetheless, features proximal openings (or ports) in the baffle can be thinner and/or more flexible, while the portion connecting the upper lip and the baffle can be a thicker, more rigid portion. These portions having a higher level of rigidity can optionally have a Shore A durometer of between about 70 and about 70-100.

Cleanability is in part a function of having a clearance between the baffle and the upper lip feature sufficient to enable water to pass-through to clean and rinse, and preferably, the clearance enables a small brush to access all surfaces between the baffle and the movable member.

Another aspect of the present disclosure resides in simplified assembly of the cup. In one embodiment, the lid has a cup connection means to the cup, and likewise the cup has a lid connection means to the lid, that provide, for example, a press-fit, friction-fit or a snap-fit connection between the lid and cup. Once the snap-fit, friction-fit, or press-fit connection is achieved, the lid is fixed into place for use with the cup. The cup's lid connection means includes a lip or a rib. When the lid is press-fit, friction-fit, or snap-fit to the cup, the user is aware of the connection by an audible and/or tactile sensation when the cup connecting means slide over the lid connecting means (or vice-versa, depending on how the cup and lid are positioned with respect to each other). When the cup is empty and it needs to be opened for refill or cleaning, the user pushes on one side of the lid to release the lid from its fixed position, causing the opposite side of the lid to rotate upward, enabling the user to grasp the opposite end and remove the lid from the cup.

In another embodiment, the cup has a tapered wall assembly permitting a press-fit connection between the inner wall of the cup and the lid. The tapered wall in this instance is at least part of the cup's connecting means. The user simply pushes the lid downward into the cup past the cup ledge until a sufficient resistance is felt (approximately 10-40 lbs). The user will also see the upper periphery of the lid align proximal to the upper outer periphery of the cup. Both the release of resistance after the ledge has been bypassed, and the visual alignment signal to the user that the cup is ready for use. To remove the lid, the user pushes on one side of the lid to release the lid from its fixed position, causing the opposite side of the lid to rotate upward, enabling the user to grasp the opposite end and remove the lid from the cup.

In another embodiment, the lid engages the cup via a threaded connection. The lid has internal threads and is rotated onto the cup (having external threads) to establish a secured condition that is ready for drinking. Upon rotation in the direction opposite the rotation of connection (example—counterclockwise loosens the lid while clockwise tightens), the user can open/disassemble to refill or clean.

In another aspect of the present disclosure, the outer lip, is located about the upper outer periphery of the cup or on the upper outer periphery of the lid, such that the outer lip has an outer lip periphery. The inner lip is on the lid. The outer lip and the inner lip define a gap therebetween. When the inner lip is deflected, the gap enables fluid to flow through and out of the cup assembly.

In yet another aspect of the present disclosure, the lid assembly has an improved sealing feature. In such embodiments, the cup provides an audible or tactile indication to the user that the lid components have been securely fastened together. This feature has the additional benefit of creating mating engagement amongst the lid components such that they are in-fact assembled into a single piece. Further, the assembly enables lid components to be nested, assembled, and/or stacked from (or into) one end of the lid portion that connects to the cup, such as a collar component. In such embodiments, one or more protrusions (or protuberances) such as one or more detents, tabs, a tab with a detent, or ribs is located radially outward on the baffle. One or more ledges is located inward and/or above the lid connecting means. Optionally, one or more recesses is located within, outward, and/or above the cup connecting means on the lid. Once the baffle is inserted into the lid (or vice-versa), the one or more protrusions passes over the cup connecting means and engages the one or more ledges or recesses thereby providing an indication to the user that a proper connection (and seal) has been achieved between the lid and the cup. In some embodiments, one or more protrusions interferes with the uppermost portion of the cup connecting structure such that when the lid assembly is attached onto the cup, the connection between the cup connecting means and lid connecting means exert pressure on the baffle therein exerting pressure against the movable member, thereby improving the seal amongst the lid and cup components and mitigates against leaks.

The present disclosure enables the movable member and to be inserted into the lid (or collar), and the baffle onto the lid all from one end. Preferably, particularly where there are handles integral with the lid (or collar), the moveable member and baffler are inserted into the lid (or collar) through the lower end of the lid (or collar) such that the upper end of the lid (or collar) rests flat on a table or counter. Alternatively, the present disclosure enables the movable member and baffle to be a single component, or attached to each other by a press-fit, snap-fit, interference fit, and/or detent connecting means, which also simplifies assembly.

In another aspect of the present disclosure, the movable member and the baffle are connected to each other without an additional connecting piece. In existing lip activated lids, the movable member attaches to the lid collar from the top, while the baffle connects from the underside of the collar. A fastening element secures the baffle to the movable member, wherein a ledge of the collar feature is sandwiched between the baffle and moveable member. The fastening element is attached adjacent the underside of the baffle that is opposite the topside of the baffle that engages the collar ledge and the movable member. Such assembly requires two hands and holding multiple components together before assembling the fastening element to thereby create a lid assembly.

In yet another aspect of the present disclosure, the lip activated lid is interchangeable amongst other more traditional spout and straw lids such that any of these lids can be used on any of their respective mating cups. This further reduces assembly complexity and enables a user to further mix-and-match lids to cups.

DETAILED DESCRIPTION OF THE INVENTION

Figure 1:
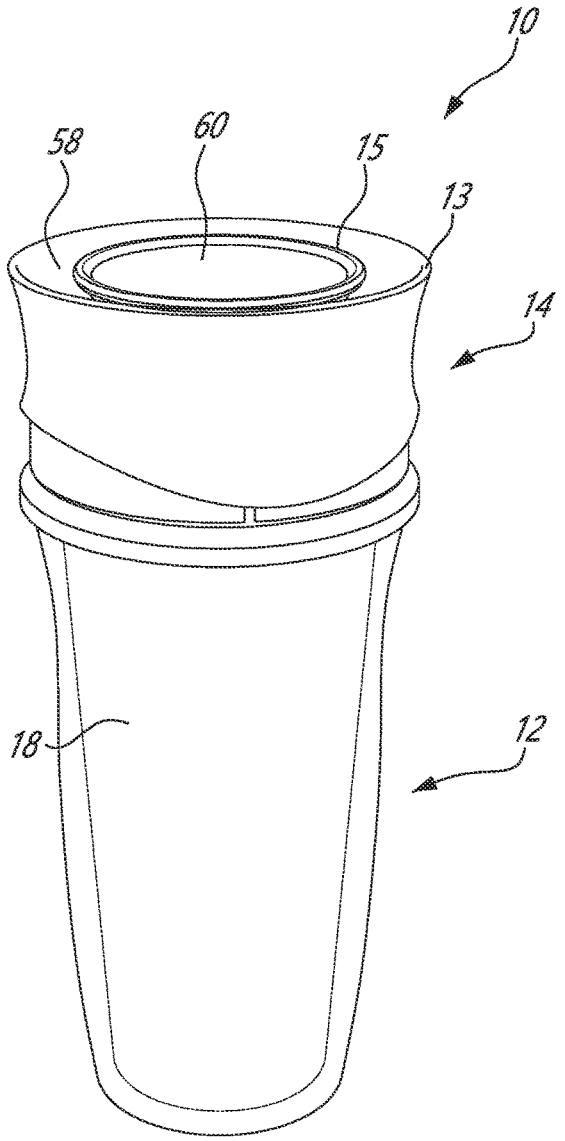
FIG. 1 is a front view of an embodiment of the present disclosure.
Figure 2:
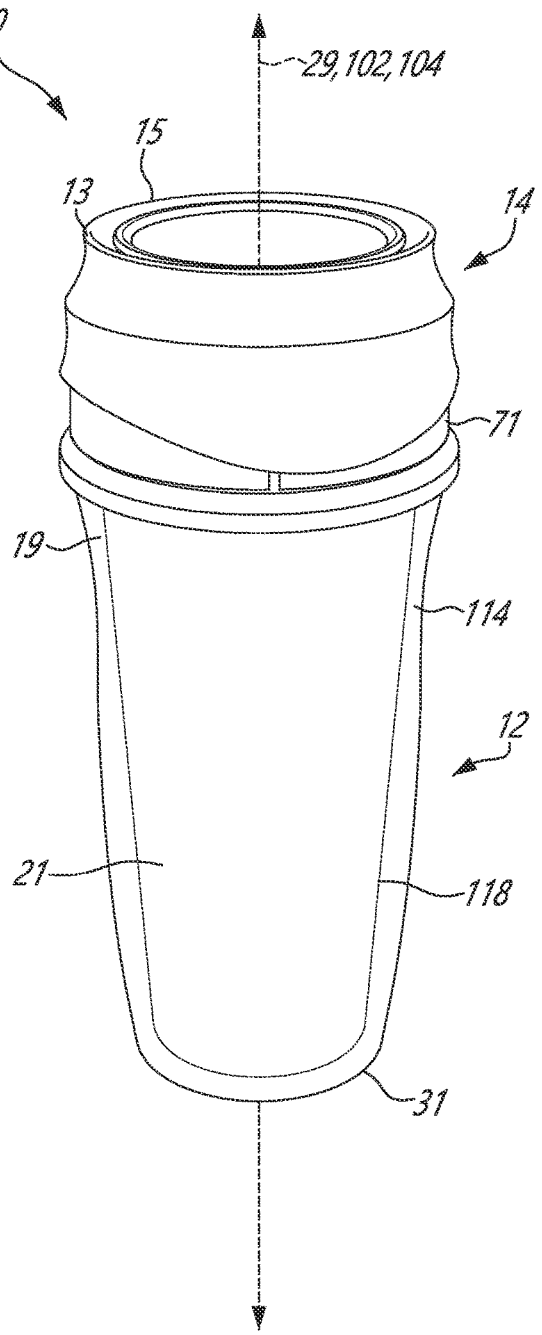
FIG. 2 is a front view of an embodiment of the present disclosure.

The figures represent various embodiments of cups and containers that mitigate against spills while also teaching a child how to drink from an open rim cup by utilizing a lip deflecting feature. Referring generally to FIGS. 1, 2, 3*a*, 3*b*, and 4-10, the cup (or container) assembly 10 of the present disclosure includes a cup (or container) 12 and a lid 14. The cup (or container) assembly 10 has a central vertical axis 29. The cup (or container) 12 has a cup (or container) vertical axis 104, and the lid 14 also has a lid vertical axis 102. When the cup 12 and lid 14 are fully connected (or fully-assembled), the cup vertical axis 104 and the lid vertical axis 102 are substantially coaxial and/or coterminous with the central vertical axis 29 and to each other.

Cup assemblies 10 have a lid 14 with a movable, deflectable, and/or deformable inner top portion 48 with an inner lip 15. At least the inner lip 15 (if not generally all of moveable member 48) is deflectable when a force is applied against it and as such, is lip activated. Upon deflection (via the force applied by a user's lip(s)), the inner top portion 48 moves (with respect to the lid vertical axis 102) to create an opening 11 for fluid to flow between the inner lip 15 and the outer lip 13 (of the lid 14 or optionally the cup 12). The movable member 48 and/or baffle 59 is(are) biased into a closed position such that, without the application of a force directed to the inner top portion 48, the lower outer periphery 55 and/or the middle portion 67 remains substantially sealed against the ledge 17 of the lid 14 (or cup 12). Where the middle portion 67 creates the seal with the upper inner ledge portion 41 (thereby defining an inner ledge periphery 24) of ledge 17, lower outer periphery 55 is adjacent middle portion 67 such that it is sandwiched between the cup upper rim 37 and middle portion 67. As such, when lid 14 is assembled onto cup 12, cup upper rim 37 applies pressure against lower outer periphery 55*m* which applies pressure against middle portion 67, which applies pressure against ledge 17 thereby creating a seal in the closed position. In this fashion, the cup assembly 10 mitigates against spills when the cup assembly 10 is tipped such that the lid 14 is other than substantially parallel to the ground or the surface on which the cup assembly 10 rests.

The cup 12 includes a cup body 18 suitable for retaining and storing a volume of liquid (or other material such as solid foods). The cup (or container) 12 has a width (or diameter) 65 at its upper end at the rim 37 of between about 40 mm and about 120 mm, or more preferably between 60 mm and about 90 mm. The cup (or container) 12 has a cup height 64 between about 50 mm to about 140 mm. For cup embodiments, the cup 12 is more preferably between about 90 mm and about 140 mm. For container 12 embodiments, the container 12 is more preferably between about 50 mm and about 90 mm.

Figure 8:
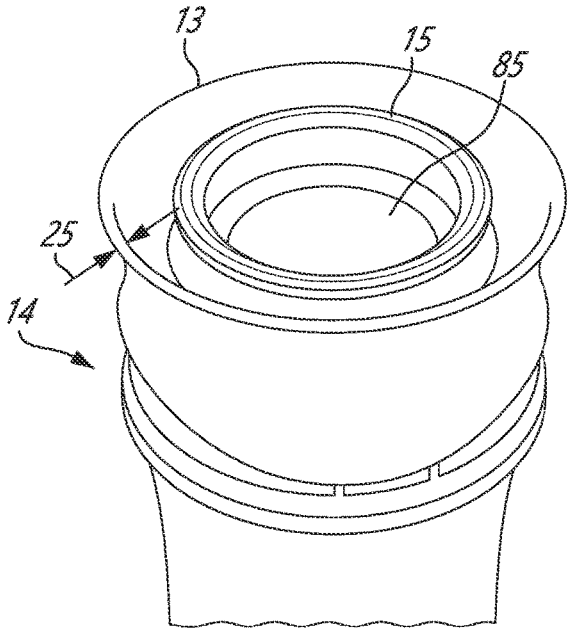
FIG. 8 is an angled top view of an embodiment of the present disclosure.
Figure 9:
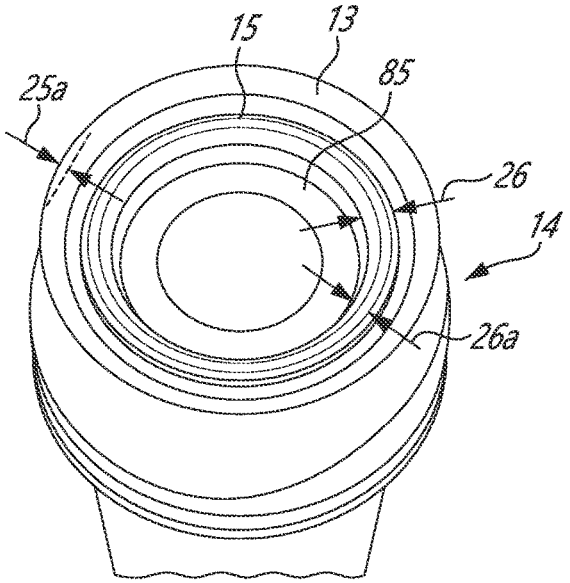
FIG. 9 is an angled top view of an embodiment of the present disclosure.
Figure 10:
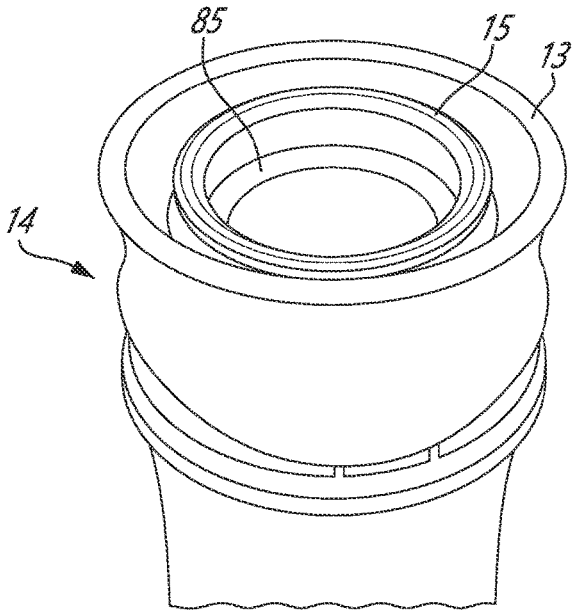
FIG. 10 is an angled top view of an embodiment of the present disclosure.

The cup body 18 has a connection portion 21, an upper wall 19 adjacent the connection portion 21, and a lower wall 27. The connection portion 21 includes lid connecting means 22 such as threads or thread segments 22*a* as defined above, and/or a ledge 17. In other embodiments, the connection portion 21 includes a taper 20 in the cup body 18. The connection portion 21 is distal from the upper portion of the cup proximal upper outer perimeter (as exemplified by outer lip 13). In some embodiments as shown in FIGS. 1, 8 and 10, the outer perimeter of outer lip 13 is the largest perimeter of the cup assembly 10, other than any handles 30. In other embodiments, the largest perimeter of the cup assembly 10 is located about lid outer perimeter 44*a*, about cup 12 connecting wall 21.

As exemplified in FIGS. 1-3*b*, the cup 12 can have a taper 20 such that the lower wall 27 is slightly narrower than the upper wall 19. In some embodiments, the cup lower wall 27 is only slightly narrower than the upper wall 19 in order to avoid having the cup's 12 center of gravity being too high to reduce instances where the cup 12 tips-over when set-down unsteadily or jostled when resting on a generally flat surface. As exemplified in FIGS. 4, 11, 12, 14, and 15, cup 12 has a more significant taper 20 between connecting portion 21 and the upper wall 19. Such a taper 20 is further conducive to embodiments having one or more handles 30, thereby enabling a user to easily grasp the cup 12 about the cup body 18 between the handles 30 or the cup 12 by the one or more handles 30.

The cup body 18 has a thickness 23 that can be constant or vary along the entirety of the cup body 18. In some embodiments, the cup thickness 23 is greater in the cup connecting wall 21 and shoulder 100, and proximal the cup bottom 31. The cup thickness 23 is typically uniform about a horizontal slice along the central vertical axis 29 (with the exception of any deviations due to lid connecting means 22), and/or also amongst vertical radial slices about the central vertical axis 29 (except where, for instance other cup or container 12 features exist, such as where one or more handles 30 connects to the cup or container 12). In some embodiments, the cup 12 has an upper wall thickness 33 that has a greater thickness (in at least some portion of the upper wall 19) than at least some portion of the lower wall thickness 34.

Figure 15:
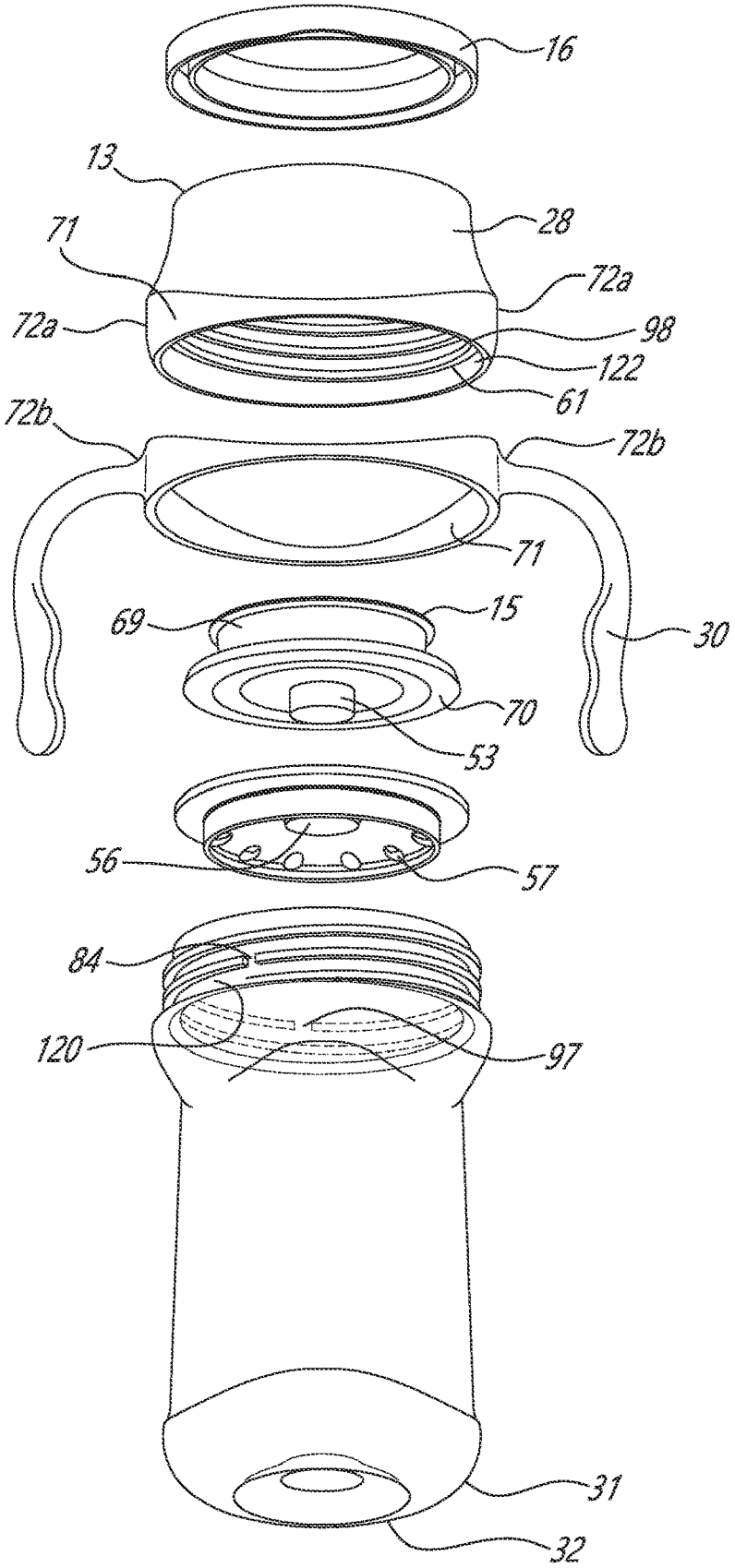
FIG. 15 is an exploded view of an embodiment of the present disclosure.

As shown in FIG. 15, some embodiments of the cup 12 provide one or more feet 32 (or pedestal(s), or a variation in topography) to reduce the contact area of the cup bottom 31 and the surface on which the cup 12 rests. This mitigates in the cup 12 sliding off a wet surface and facilitates drying of the cup bottom 31 when the cup is at rest and sitting upright on the one or more feet 32.

In some embodiments, the cup assembly 10 has one or more handles 30. The handles 30 are suitably sized for grasping by a child. In some embodiments, one or more handles 30 are elongate. Optionally, the handles are removable from the cup assembly 10. The one or more handles 30 are optionally connectable to the upper wall 19 and extend downward towards the cup bottom 31, or are connectable to the cup bottom 31 and extend upward towards the upper wall 19. The one or more handles 30 are spaced a suitable distance from the cup body 18 such that the child can grasp the one or more handles 30 and/or the child or caretaker can grasp the cup 12 between the one or more handles 30 and cup body 18. The one or more handles 30 are optionally attachable by a friction fit about the body 18 of the cup 12 or lid 14, and further optionally have alignment features 71. Alignment features 71 can include, for instance, male and female members such as one or more ribs and one or more mating recesses, a ledge or shoulder forming a seat to receive the handles 30, etc., located on the cup outer wall 113 and handles 30, or optionally on lid 14 and handles 30. In embodiments where the lid 14 is in the form of a collar, handles 30 can be integral with the collar or can be removably connectable to the lid 14 via friction fit or by alignment features 71. Alignment features 71 optionally include keying features 72*a* and 72*b*, where one feature is male and the other is female. One of keying features 72*a* and 72*b* is on one or more handles 30, while the other is on either the cup 12 or lid 14. Keying features 72*a* and 72*b* further improve the ease of connecting one or more handles 30 to cup 12 or lid 14, and/or improve the strength of the connection. The shape of the alignment features 71 can be carried-throughout the cup assembly 10 as a design element. For example, and as shown in FIGS. 4 and 11, 14, and 15, the upper wall 19 and the lower wall 27 proximal cup bottom 31 has a wave shape similar to that of alignment features 71.

The cup assembly 10 includes a lid 14 connectable to the cup 12. As exemplified in FIG. 11, The lid 14 includes an upper portion with an outer lip 13 located about the upper outer periphery of the lid 14, and inner lip 15 inward of outer lip 13. Outer lip 13 is optionally beaded or rounded, having an outer lip width 25 that is between about 1.0 mm to about 4.0 mm, and more preferably between about 1.5 mm and about 2.5 mm. Outer lip radius (or thickness) 25*a* is between about 0.25 mm and about 4.0 mm, and more preferably between about 0.5 mm and about 2 mm. Inner lip 15 is optionally flat, having a lip width 26 that is between about 1.0 mm to about 10 mm, and more preferably between about 1.5 mm and about 5 mm. Inner lip radius (or thickness) 26*a* is between about 0.25 mm and about 5.0 mm, and more preferably between about 0.5 mm and about 3 mm. Lip 13 and/or lip 15 is optionally angled or tapered, having a lead-in suitable for drinking or to engage with movable member 48 as described below.

Outer lip 13 and inner lip 15 define a gap 58 having a gap width 43 of between about 1 mm and about 5 mm, and preferably between about 2 mm and about 4 mm. Gap 58 also has a gap depth 45 of between about 5 mm and about 15 mm. Gap 58 permits fluid to flow out of cup assembly 10 when inner lip 15 is deflected downwardly by a force applied thereto. As such, the gap 58 is sized—in width 43 and depth 45—to permit fluid to pass by inner lip 15 when inner lip 15 is in a deflected position.

Inferior to the outer lip 13 is a ledge 17. The ledge 17 is extends inward from the lid 14 outer periphery 44*b*. The ledge 17 is generally flat but is optionally chamfered or arcuate. The ledge 17 has a ledge inner perimeter 24 that is larger than the outer perimeter 49 of inner lip 15. Where movable member 48 is a flexible material, the ledge inner perimeter 24 is only slightly larger than the upper outer perimeter 49 such that movable member 48 can be deflected past ledge 17 and be assembled from the bottom of collar 48. The ledge 17 is generally perpendicular to the lid central vertical axis 102. In some embodiments, the ledge 17 varies in thickness to accommodate manufacturing preferences while providing a suitable surface for the lower outer periphery 55 to mate to and provide a seal in a rest (non-use) state. Albeit a rest (or non-use) state, the lower outer periphery may exert a force against the ledge 17 (optionally via the engagement of cup connecting means 61 and lid connecting means 22 thereby sandwiching lower outer periphery 55 (and middle portion 67) between collar 28 having cup upper rim 37) in order to ensure the cup assembly 10 maintains a seal between such components upon being tipped to mitigate against spills.

The lid 14 includes center portion 60. The baffle engaging portion 53 and movable member engaging portion 56 are located in center portion 60. The movable member 48 has inner lip 15 extending upward and/or outward from center portion 60. Inner lip 15 and outer lip 13 define a gap 58. The movable member 48 has a baffle engaging portion 53 below the inner lip 15. The inner lip 15 has a perimeter 49 that is at greater than the inner perimeter 24 of the ledge 17. The baffle engaging portion 53 has a perimeter 63 that is at slightly smaller than and up to slightly greater than the perimeter 66 of the movable member engaging portion 56. Such geometries of the baffle engaging portion 53 and movable member engaging portion 56 assist in creating a connection between the baffle 59 and the movable member 48. Such geometries enable an easy sliding fit and/or a press-fit engaged by friction or interference, such that these components are easily separable and connectable. Ribs (or detents) 62 assist in achieving such engagement means. Such connection is intended to require a low force to connect or disconnect, such that (a) the components are easy to attach together prior to use, and (b) the components are easy to separate and easy to clean. As such, it is preferable that the connecting force required to connect and disconnect the movable member 48 (or upper portion 50) and baffle 59 (or lower portion 54) via the baffle connecting means 53 and the movable member connecting means 56 is less than or equal to 5 lb-in, less than or equal to 3 lb-in. less than or equal to 2 lb-in, or less than or equal to 1 lb-in.

In some embodiments, the baffle 59 is connectable to collar 28 of the lid 12. Collar 28 has an outer surface and an inner wall 116 opposite the outer wall 112. The baffle 59 has one or more protrusions 81 that engage the lid inner wall 116, thereby creating a friction fit and retaining the baffle 59 (and thusly the movable member 48) in the lid 14. Preferably, the one or more protrusions 81 is as at least two protrusions 81, at least three protrusions 81, at least four protrusions 81, at least five protrusions 81, or at least six protrusions 81. Multiple protrusions 81 are preferred to assist in retaining baffle 59 in collar 28 about multiple peripheral points such that it is (a) easier to assemble due to the lid 14 remaining in a single unit that can be collectively attached to cup 12, and (b) remains in a secured position upon disassembly until the user is ready to fully disassembly baffle 59 from collar 28. The one or more protrusions 81 provide an audible and/or tactile indication to the user that the lid 14 has been fully assembled. When the one or more protrusions engage the inner wall 116, a "click" sound is generated and/or a slight flexure of the lid 14 is felt. Such sound or flexure informs the user that the lid 14 is assembled and can be easily connected to the cup 12.

In some embodiments, baffle engaging portion 53 and movable member engaging portion 56 are unitary and thus are integral and/or do not need to be separated for cleaning. In some embodiments, the movable member 48 and/or the baffle 59 are made of a flexible material such as silicone, TPE, rubber, latex, or other thermoplastic materials. Alternatively, the movable member 58 and/or the baffle 59 are made of a more rigid plastic material such as polypropylene, kostrate, polyethylene, polyester, and/or combinations thereof. Preferably, at least one of the movable member 48 and baffle 59 are at least partially a flexible material. The baffle 59 can be a generally rigid material such as a hard plastic, or it can be a generally flexible material.

In some embodiments, the baffle 59 and movable member 48 are integral. Such configuration requires a flexible material with sufficient rigidity to permit deflection without complete distortion of the movable member 48 and baffle 59 when the inner lip 15 (lip activated portion) is depressed by the user. In this embodiment, the movable member 48 and baffle 59 are held in place between the cup connecting means 61 and lid connecting means 22. One or more protrusions 81 on the lower outer periphery 55 of lower portion 54 engage one or more recesses 82 proximal and under ledge 17 on the lid [that is(are) above the cup connecting means 61]. Alternatively, one or more protrusions 81 engage the cup connecting means 61 such that the one or more protrusions 81 interfere with at least a portion of cup connecting means 61 (and likewise with the connection to lid connecting means 22). In some embodiments, the cup connecting means 61 are threads or as otherwise discussed in the present disclosure.

The second portion 54 has a baffle 59 including one or more openings 57 that control fluid flow 11 from the cup 12 volume through and outward of movable member 48, and more specifically, past the outer periphery 68 of middle portion 67. In the embodiments shown in FIGS. 11-12, the lower outer edge 55 has a greater width than the upper outer edge 49. The one or more openings 57 are radially inward of the outer edge 55 of second portion 54 such that the openings 57 do not interfere with the cup connecting means 61. The one or more openings 57 are radially inward of and/or below middle portion outer periphery 68. The one or more openings 57 are radially inward of and/or below ledge 17.

As shown in FIGS. 6-9, the one or more openings 57 are positioned radially outward of the center portion 60. In some embodiments, the one or more openings 57 are not impeded by the cup connecting means 61, In some embodiments, the one or more openings 57 are not immediately adjacent upper outer periphery 49.

The baffle 59 includes at least two openings 57 through which water can flow. In other embodiments, there are at least three openings 57, at least five openings 57, at least 10 openings 57, and optionally at least 12 openings 57. In some embodiments, the surface area 40 of the one or more openings 57 is between about 2 $mm^2$ and 620 $mm^2$, where the openings 57 and/or the surface area 40 is distributed generally evenly around the lower outer periphery 55 of the baffle 59. Such generally even distribution of surface area 40 around the baffle 59 ensures a generally even amount of flow no matter what region of the movable member 48 is activated.

In some embodiments like those shown in FIGS. 5, 6, 16, 16*b*, 17, and 18 there are at least two openings 57, at least five openings 57, at least 10 openings 57, and optionally at least 12 openings 57. In some embodiments, the one or more openings 57 are up to about 30. In some embodiments, there are between about 1 and 30 openings 57, or between about 15 and 15 openings 57. In some embodiments, the one or more openings 57 are at a series of heights or at different radial widths about the lid 14, or have different geometries/sizes.

Each of the one or more openings 57 has a length 35 between about 1 mm and about 10 mm, or between about 2 mm and about 6 mm. Each of the one or more openings 57 has a width 36 between about 1 mm and about 10 mm, or between about 1 mm and about 3 mm. Each of the one or more openings 57 has a depth 38 between about 1 mm and about 10 mm, or between about 2 mm and about 6 mm. In some embodiments, the surface area 40 of the one or more openings 57 is between about 2 $mm^2$ and 620 $mm^2$, or between about 100 $mm^2$ and about 350 $mm^2$, or between about 100 $mm^2$ and about 250 $mm^2$, where the one or more openings 57 and/or the area is distributed generally evenly around (but inward of so as to not interfere with the cup connecting means 61) the perimeter or outer edge 55 of the baffle 59 (or the second portion 54), or optionally, the surface area 40 is generally distributed so that any given radial section including at least one opening 57 would be similar to any other given radial section including at least one opening 57. Such generally even distribution of surface area around the baffle 59 ensures a generally even amount of flow no matter what region of the inner lip 15 is activated. The baffle 59 can be a generally rigid material such as a hard plastic. As discussed below and as exemplified in FIG. 10, baffle 59 can be a generally flexible material that enables deflection.

Figure 13:
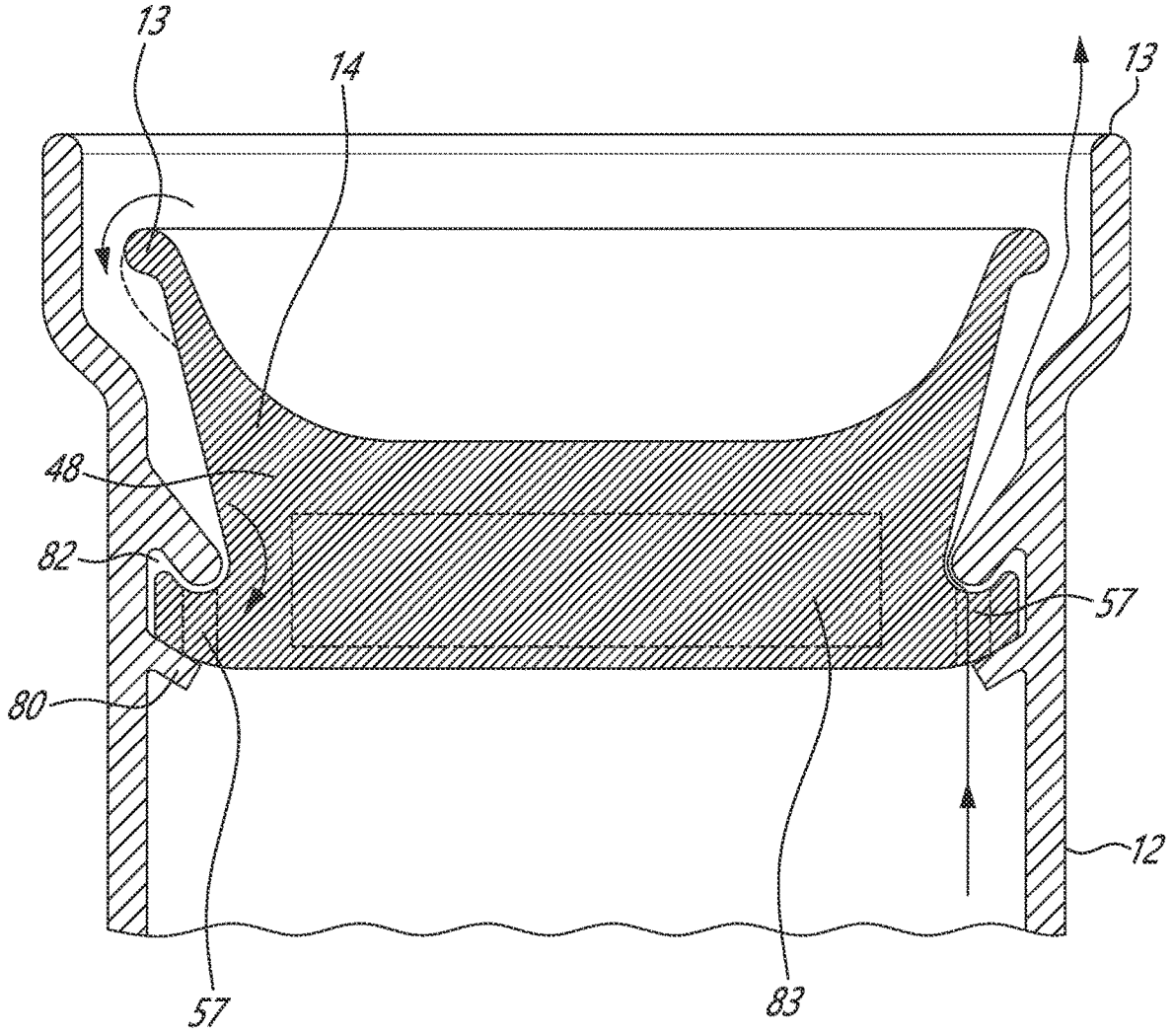
FIG. 13 is a front view of an embodiment of the present disclosure.

As exemplified in FIG. 13, the cup assembly 10 includes a unitary lid 14. The baffle 59 is a flexible material that deflects upon application of a force to upper lip 15. In a connected and sealed rest position, baffle 59 has one or more openings 57 positioned under lid connecting means 22 in the form of ledge 17. Upon application of a force by a child, the upper lip 15 deflects downward and inward from outer lip 13 thereby causing movable member 48 to move downward and inward from ledge 17. The deflection of movable member 48 (as shown by curved arrows in FIG. 13) causes baffle 59 to shift causing the one or more openings 57 to come out of alignment from ledge 17, thereby permitting fluid to flow (as shown by arrow 11 on FIG. 13) from the cup volume, through one or more openings 57, and out of the space between the outer lip 13 and inner lip 15. When the force is released, the movable member 48 returns to its rest position and causes the baffle 59 to reposition itself such that the one or more openings 57 align with ledge 17 closing off fluid flow 11. In such embodiments, outer lip 13 is on cup 12 and coterminous with cup upper rim 37.

Embodiments similar to the embodiment shown in FIG. 13 have a cup assembly 10 where the lid 14 is connected to the cup 12 by downward motion of the lid 14 through cup upper rim 37 (having outer lip 13) by a snap-fit, friction-fit, or press-fit. To fully-assemble the cup assembly 10, the user applies downward pressure to, at minimum, the center portion 60 and/or opposite sides of the lid 14 such that the lid 14 remains parallel to the cup bottom 31 during the assembly process. The outer edge 55 of the baffle 59 portion of the lid 14 is flexible enough to flex past ledge 17 and create a sealed connection with cup 12. The user is able to determine when a connection is achieved by one or more of the following: visual alignment of movable member 48 and the upper geometry of the cup 12 (example—inner lip 15 being proximal outer lip 13 such that inner lip 15 and outer lip 13 are generally coplanar, or baffle 59 being adjacent ledge 17 such that one or more holes 57 are covered by ledge 17 and thusly not visible), the audible and/or tactile sensation caused by the press-fit and/or snap-fit, and the equal-and-opposite force felt when the lid 14 cannot be pushed further downward into cup 12. In these embodiments, the lid 14 can be removed from the cup 12 by pressing one side of the lid 12 downward, causing the opposite side of the lid 14 to deflect upward (via the outer edge 55 of the baffle 59 deflecting and thereby passing over the ledge 17). The user can then grasp the opposite side that is elevated with respect to ledge 17 and remove the lid 14 from the cup 12.

In the embodiments exemplified by FIG. 13, the cup includes ledge 17 and optionally additional retention features 80. Retention feature 80 is a rib, recess or detent, or similar in structure to ledge 17 below and parallel to ledge 17 (to form a sandwich connection by which outer edge 55 of lid 14 is retained therebetween). To mold such a cup 12, an undercut would be required, thereby adding manufacturing complexity and cost. As such, ledge 17 and other similar retention features 80 can be angled such that they are not entirely perpendicular to the lid vertical axis 102, thereby having a slight taper and being similar to one or more threads or thread segments (thereby having at least one break such that the rotating core tool can unscrew from the ledge 17 and/or retention features 80). Such a design would enable manufacturing with a mold having rotatable core, similar to those that are used to mold threads into many of the other embodiments of the present disclosure. In such embodiments, outer edge 55 can likewise be angled with respect to lid vertical axis 102 such that it has a slight taper, and can thusly be rotated into cup 12 for connection as opposed to a press-fit, snap-fit, friction-fit, and/or detent connection.

Embodiments having a one-piece lid 14 can be made from a single material with varying thickness (to accommodate portions that need to flex while other portions need to be substantially rigid). Optionally, the lid 14 can be made from a substantially rigid plastic material as discussed in the present disclosure forming a core 83, with a flexible material over molded onto the core 83 thereby forming the lower outer periphery 55 and the movable member 48. The core includes portions of baffle 59, as well as being located in the center portion 60. The over molded lid 14 can be a two-shot process. Further, lid 14 preferably does not have any undercuts, thereby simplifying manufacturing and reducing costs.

The lid 14 has a lid height 42 of between about 10 mm and about 60 mm, or more preferably, between 20 mm to 40 mm. The lid 14 has a lid diameter 44*a* and 44*b* of between about 40 mm and about 120 mm, or more preferably between 60 mm to 90 mm. The lid 14 includes a first portion or upper portion 50. The first portion 50 includes the inner lip 15 and middle portion 67 and generally permits sealing of the cup assembly 10 such that fluid does not escape out of the cup assembly 10 in the absence of a user-applied force. The lid 14 includes a second portion or lower portion 54. The first portion 50 and second portion 54 are configured to be a unitary piece connecting at center portion 60. In some embodiments, the lid 14 including the first portion 50 and second portion 50 are a single material, such as a thermoplastic material having a durometer of between about 30 and about 70.

Figure 16:
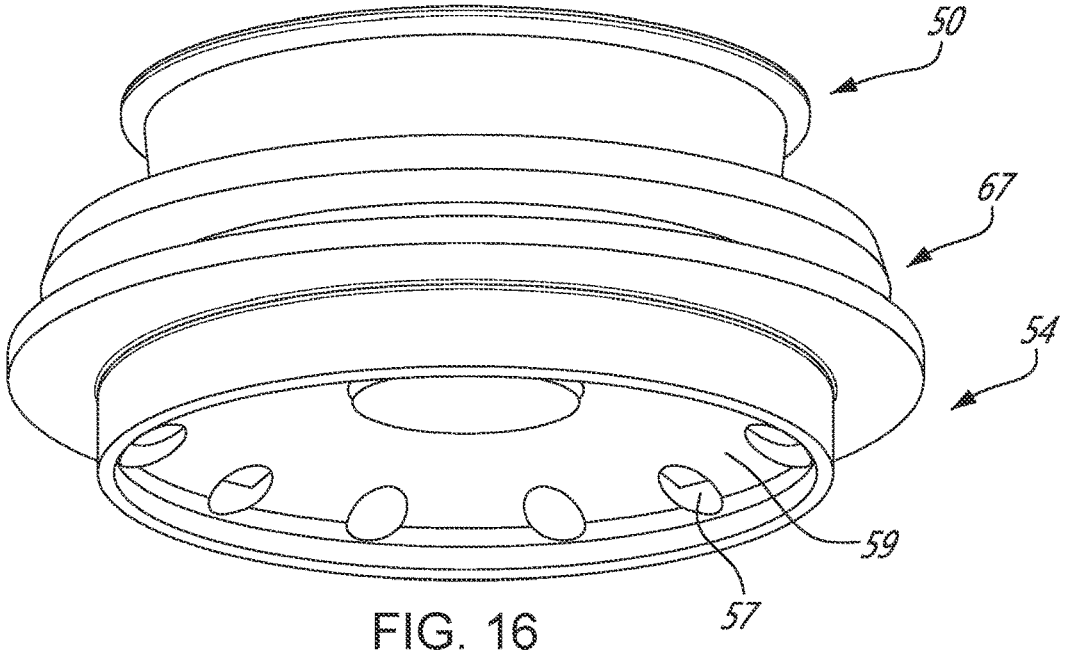
FIGS. 16-16*b* are component views of an embodiment of the present disclosure.
Figure 16A:
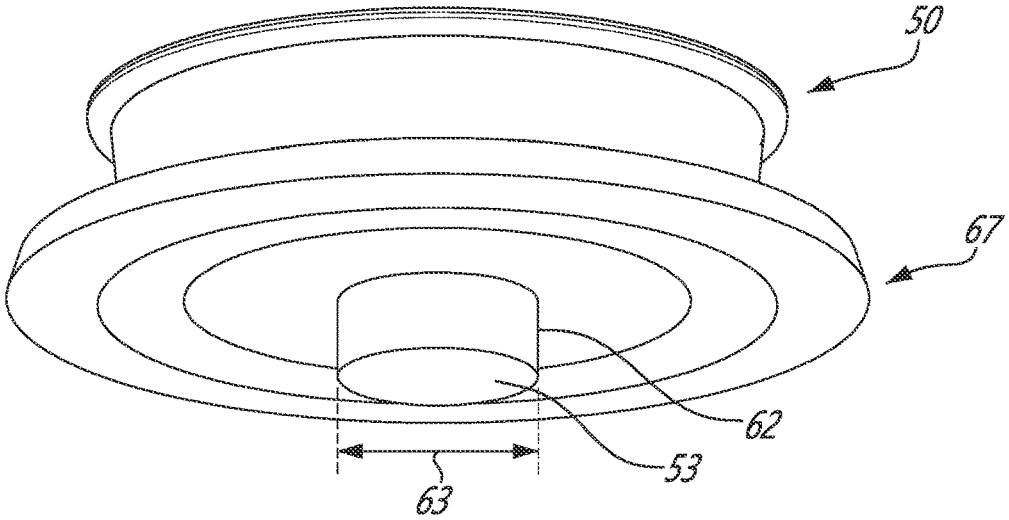
Figure 16B:
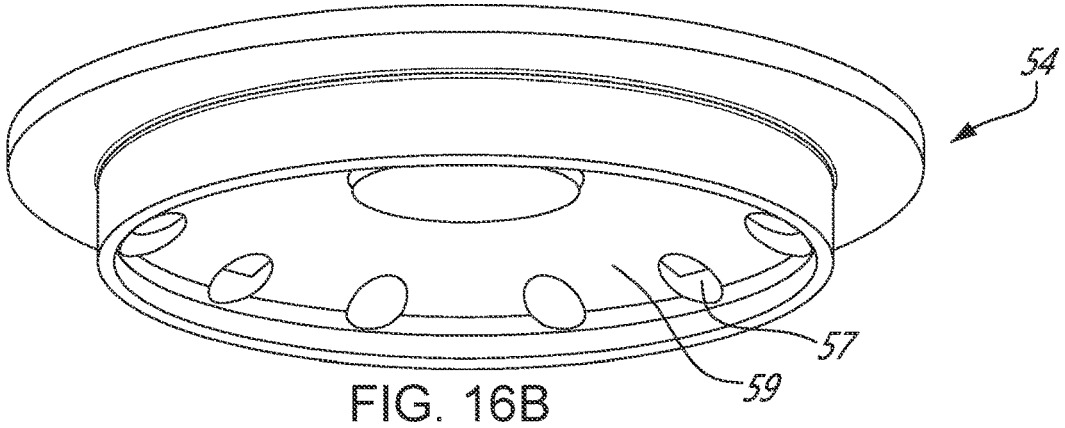
Figure 17:
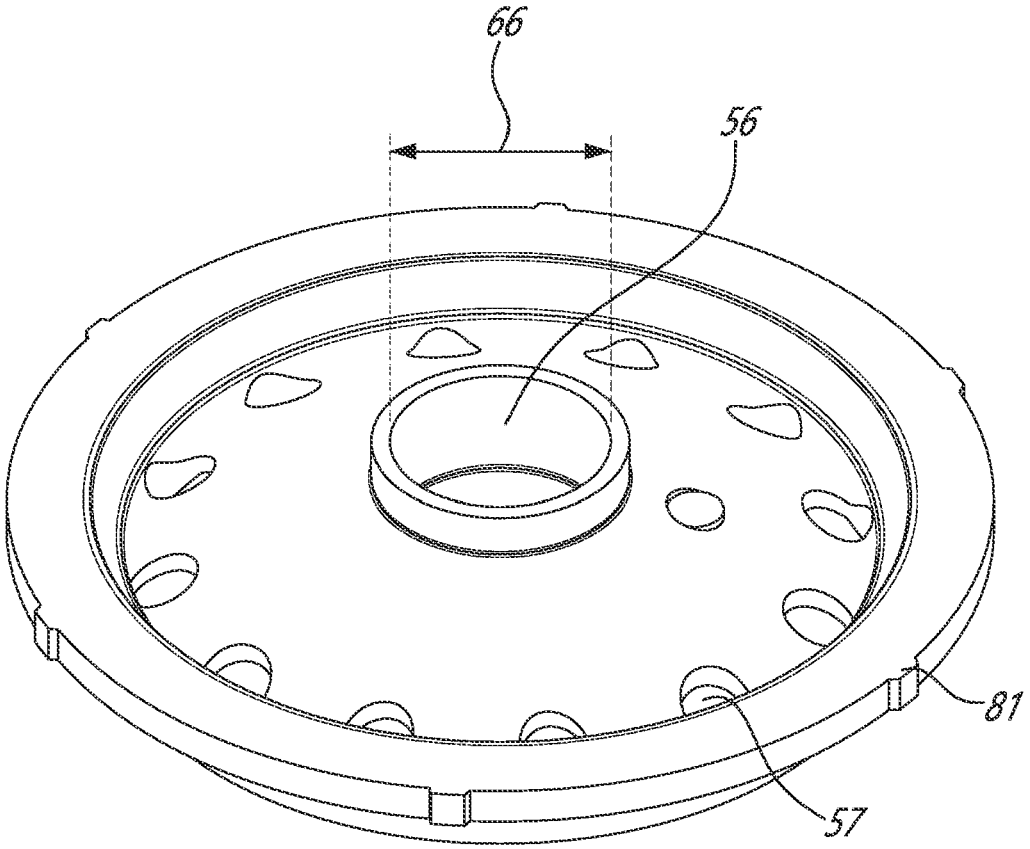
FIG. 17 is an angled top view of an embodiment of the present disclosure.

In other embodiments, the first portion 50 is a first material and the second portion 54 is a second material. In some of these embodiments, the first portion 50 and the second portion 54 can be attached to each other by mechanical means, such as by connecting means 53 (on first portion 50) and connecting means 56 (on second portion 54). Although FIGS. 15-17 show connecting means 53 as a male member and connecting means 56 as a female member, these could be opposite. Further, either of connecting means 53 or connecting means 56 could be one or more through holes having a taper or a step with the other having one or more mating projections facilitating first portion 50 and second portion 54 to be co-molded or otherwise assembled together to form a unitary structure. First portion 50 and second portion 54 can also be attached via chemical means such as adhesives, and/or other means such as welding, ultrasonic welding. In other of these embodiments, the first portion 50 and the second portion 54 are co-molded or over-molded, such as by a two-shot injection molding process.

Figure 18:
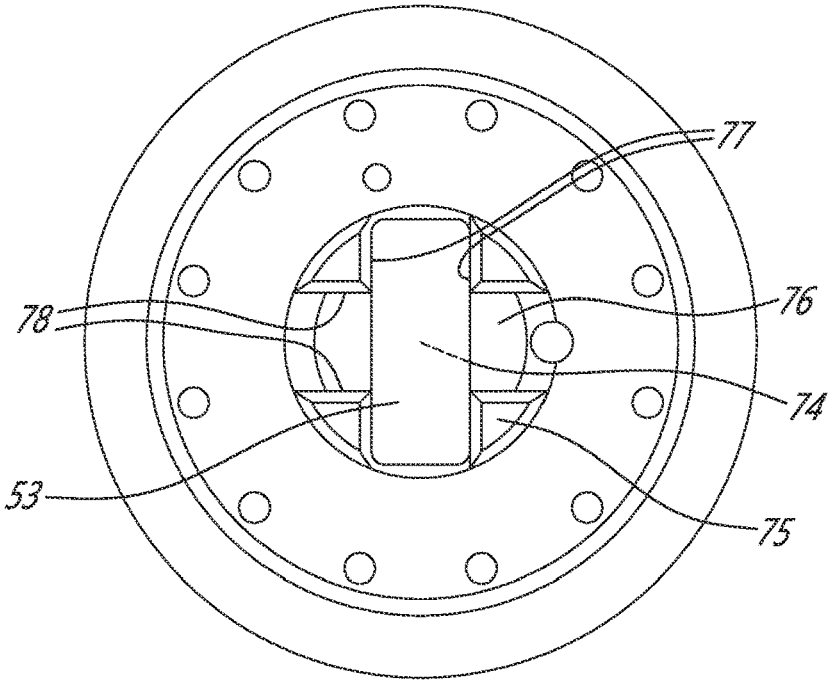
FIGS. 18-18*b* is an exploded view of an embodiment of the present disclosure.
Figure 18A:
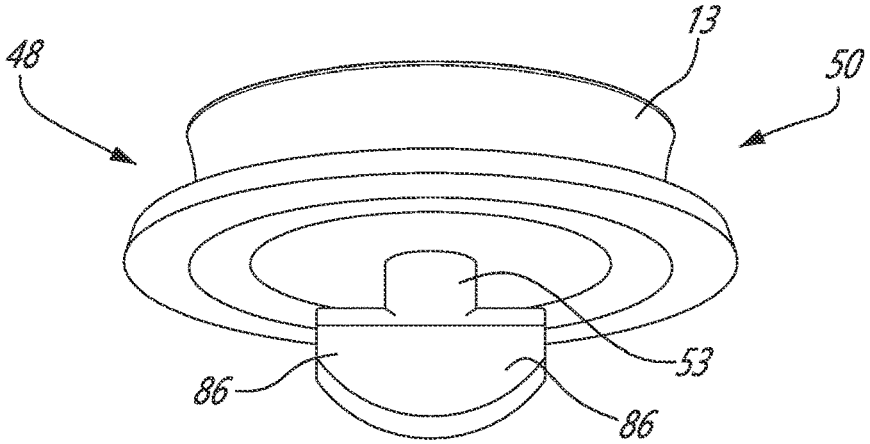
Figure 18B:
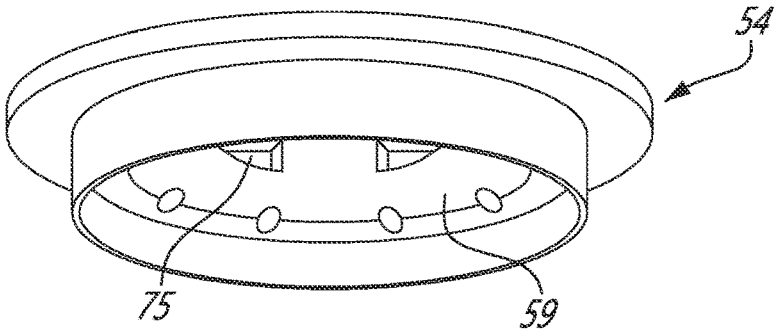
Figure 19:
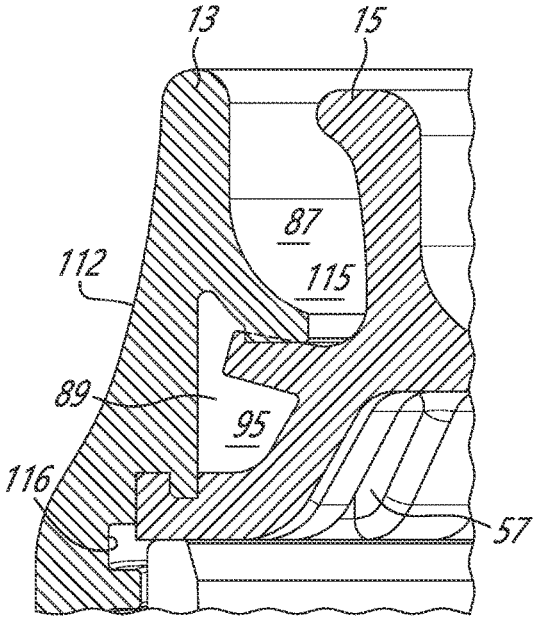
FIGS. 19, 19*a*, 20, 21, and 21*a* show schematic representations of lid embodiments of the present disclosure.
Figure 19A:
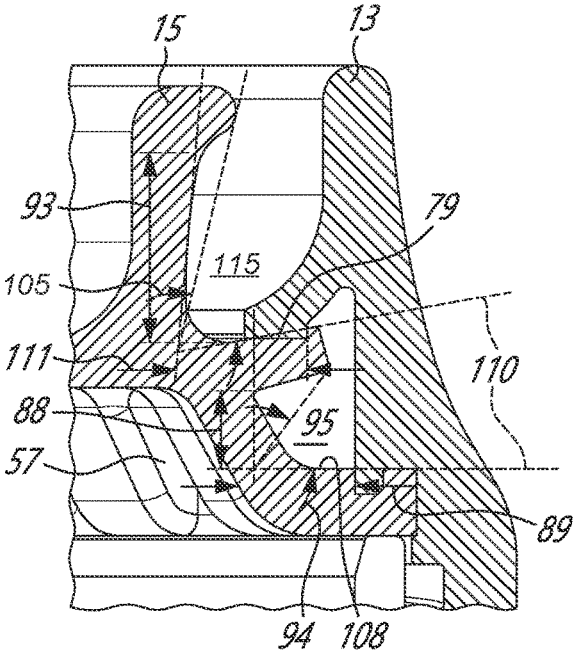
Figure 20:
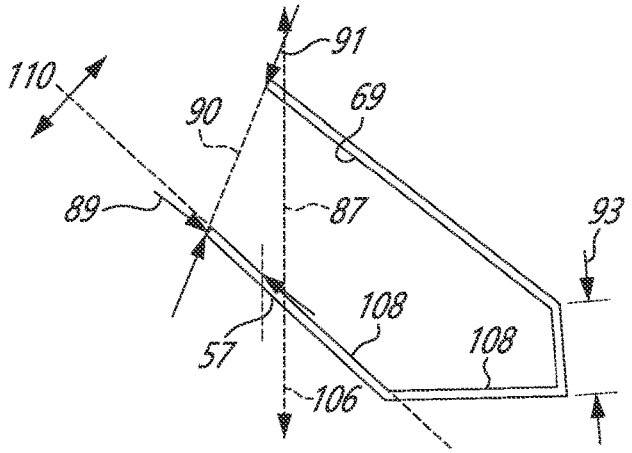
Figure 21:
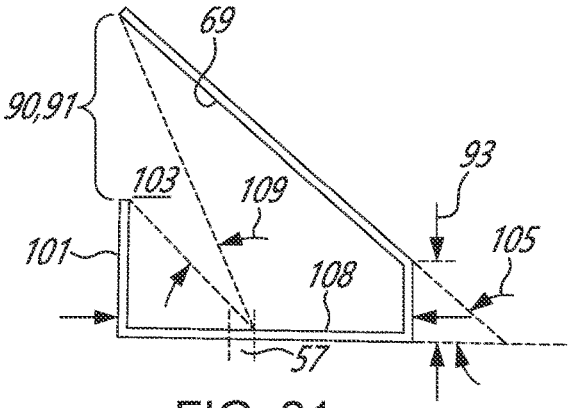
Figure 21A:
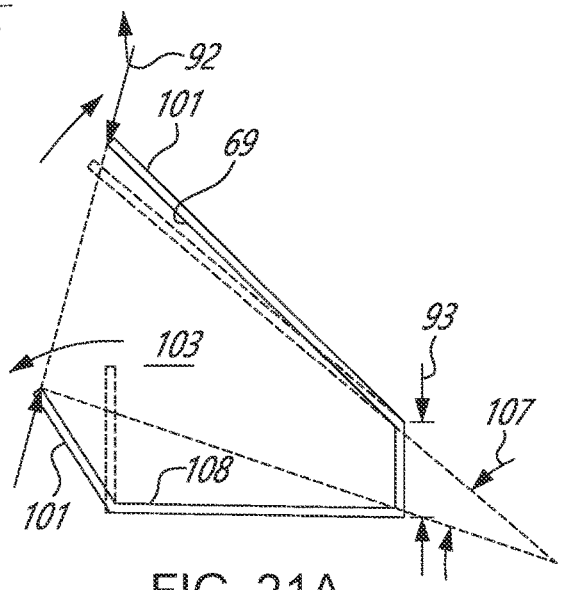

FIGS. 18-18*b* exemplify an alternate embodiment of baffle connecting means 53 and movable member connecting means 56. Baffle connecting means 53 includes plug end 73 that sits within channel 74 on movable member connecting means 56. Movable member 48 (or upper portion 50) is connected to baffle 59 (or lower portion 53) by inserting plug end 73 through channel 74 and thereafter rotating movable member 48 relative to baffle 59 such that plug end 73 rides over one or more bosses 75 and into one or more canals 76. The channel 74 is defined by boss free surfaces 77. Once plug end 73 rides over the one or more bosses 75, the plug end 73 is secured within one or more canals 76 and boss locking surfaces 78. The one or more bosses 75 can by a prismatic structure with a tapered shape. As shown in FIG. 18, four bosses 75 are provided such that plug end 73 having a general L-shape, or T-shape (or cross-sectional mushroom shape) such that it has at least one extending arm 86 fits between boss free surfaces 77 and boss locking surfaces 78. Plug end optionally has a grip surface to facilitate the rotatable connection between plug end 73 and the one or more canals 76. The baffle connecting means 53 and movable member connecting means 56 are advantageous in that it does not require a third and separate connecting piece.

In any event, the lid 14 is designed to be easy to clean to avoid harboring dirt or other soilings. For example, upper portion 50 and lower portion 54 are sealed to mitigate against foreign matter entering-into connecting portion 60. In one aspect of the present disclosure, the upper portion 50 and the lower portion 54 include a clearance 87 between the lower surface 69 of the movable member 48 and the one or more openings 57 in the top surface 108 of lower portion (or second portion, or baffle) 54. Optionally, the clearance 87 is defined to be between the lower surface 69 of upper portion 50 and the middle portion top surface 79, or between the middle portion lower surface 70 and the top surface 108 of lower portion 54. In short, the clearance is defined between two surfaces or two protruding members (or projections of such surfaces or protruding members) on lid assembly thereby creating a recess or alcove. The clearance 87 extends along an opening vertical axis 106 that is substantially parallel to the lid vertical axis 102, where the opening vertical axis 106 is position about the innermost location of the opening 57. The clearance 87 defines a clearance height between the top surface 108 of lower portion 54 and the lower surface 69 of upper portion 50 along the opening vertical axis 106, optionally between the top surface 108 of lower portion 54 and middle portion lower surface 79, or further optionally between middle portion top surface 79 and lower surface 69 of upper portion 50. The clearance height 88 is at least 0.125 inches (3 mm) such that water and cleaning instruments such as a small brush are able to access this portion of the lid 14. Preferably, clearance height is at least about 0.25 inches (6 mm). The clearance height 88 is less than or equal to about 1 inch (2.54 cm).

In embodiments having multiple surfaces (stepped, frusto-conical, tapered, and/or combinations thereof) defining the top surface 108, the clearance 87 is defined from the portion of the top surface 108 (or middle portion top surface 79) that includes the hole 57 being measured, and as such, projection 90 of the clearance opening 91 may be other than parallel to the opening vertical axis 106; the same holds true of projection 90 in embodiments with obstructions 101. In instances where multiple surfaces include multiple holes 57 that are located at different radial locations on the top surface 108, the clearance 87 is so defined with respect to any hole 57, but is most critical for hole(s) 57 most proximal to center portion 60.

The clearance length 89 is defined as the distance between the opening vertical axis 106 and the lower outer periphery 55. The clearance length 89 enables sufficient access to reach and clean the clearance 87 portion of the lid 14. Where a hole 57 is in an angled top surface 108 (or middle portion top surface 79), the clearance length 89 is defined as a projection 90 of a top surface plane 110 from the hole vertical axis 106 and extends to the outer periphery of where the angled top surface ends 108. For example, if the angled top surface 108 (or middle portion top surface 79) changes slope into a stepped surface, the clearance length 89 would be along the top surface plane 110 from the hole vertical axis 106 to where the angled top surface 108 ends and the stepped surface begins. The clearance length 89 is at least 0.125 inches (3 mm), and more preferably, at least about 0.25 inches (6 mm). The clearance length 89 is less than or equal to about 1 inch (2.54 cm).

The clearance opening 91 is defined by a vertical projection 90 between the lower outer periphery 55 (or middle portion outer periphery 68) that is substantially parallel to the opening vertical axis 106. The vertical projection 90 runs between the top surface 108 (or middle portion top surface 79) of the outer periphery 55 of lower portion (or second portion, or baffle) 54 (or middle portion outer periphery 68 of middle portion 67) to the lower surface 69 of upper portion 50 (or middle portion lower surface 70 of middle portion 67). In some embodiments, vertical projection 90 runs from the outer periphery 55 of lower portion 54 (or middle portion outer periphery 68) and the outer edge 49 of upper portion 50 (or middle portion outer periphery 68). The clearance opening 91 is at least 0.25 inches (6 mm), and more preferably, at least 0.375 inches (9 mm), and most preferably, at least about 0.5 inches (12 mm). The clearance opening 91 is less than or equal to about 1 inch (2.54 cm).

In embodiments where a surface or wall encroaches on the clearance opening 91, the clearance opening 91 as calculated above would be reduced by the length of the encroaching feature. In situations where the encroaching feature causing an obstruction 101 is flexible and can be deflected away to easily clean the blocked area, the length of deflection would be included to define a modified clearance opening 92. Modified clearance opening 92 would be subject to the same size restrictions as clearance opening 91. While obstructions 101 have been discussed with respect to clearance opening 91, the same principals would hold true for clearance height 88 and clearance length 89. In any event, it is preferable to avoid designs having channels with a length of greater than about 0.5 inches, width of less than about 0.25 inches, and a height of 0.25 inches, where such dimensions are only achievable by deflecting obstruction(s) 101.

In some embodiments, the clearance length 89, the clearance height 88, and the clearance opening 91 are small (but exceed the minimums outlined in the present disclosure) such that the clearance is easy to clean but not excessively narrow or deep. Due to constraints with configuring the center portion 60, the goal of directing fluid towards the lip 13, and controlling the flow rate of the liquid out of the cup assembly 10, it is desirous to have a clearance cross-sectional area 95 of between about 0.010 square inches (0.06 square centimeters) to about 0.75 square inches (4.8 square centimeters). The clearance cross-sectional area 95 is defined by the bounds of the clearance height 88, clearance length 89, clearance opening 91, and any obstructions 101. A modified clearance cross-sectional area 103 and modified clearance angle 109 would account for deflection of any obstructions 101.

As exemplified in FIGS. 5-10, the geometry of the lid upper surface 85, from the upper outer periphery 49 to the center portion 60, is generally flat, downwardly tapered, downwardly stepped, downwardly frusto-conical, downwardly radially arcuately stepped, slightly recessed, concave shape, or combinations thereof.

The center portion 60 of lid 14 generally designates the connection point between the upper portion 50 and lower portion 54 of the lid 14. Center portion 60 has a connecting height 93 defined as the surface (and related distance) between the top surface 108 of lower portion 54 and the lower surface 69 of upper portion 50 (or middle portion lower surface 70, depending on the construction of the lid 14). It is preferable to have a generally planar center portion 60 with a sufficient connecting height 93 to improve cleanability by avoiding crevices. Connecting height 93 is at least about 0.125 inches, and more preferably, at least about 0.25 inches. Connecting height 93 is less than about 0.75 inches, and more preferably, less than about 0.5 inches.

While the dimensions and access to connecting height 93 has been described in detail, the teachings with respect to the clearance height 88, clearance length 89, projection 90, clearance opening 91, modified clearance opening 92, clearance cross-sectional area 95, and modified clearance cross-sectional area 103, apply to connecting portion 60, as does the clearance angle 94 described in greater detail below. For example, FIGS. 19-21*a* describe the modified connecting angle 107, the connecting length 111, and connecting cross-sectional area 115.

A clearance angle 94 is defined as the angle between the intersection of a projection of the top surface plane 110 and the projection of the lower surface 69 of the upper portion 50 (or the projection of middle portion lower surface 70). Preferably, the clearance angle 94 is at least about 10 degrees, is at least about 15 degrees, at least about 30 degrees, and more preferably greater than about 45 degrees. The clearance angle 94 is less typically less than about 90 degrees due to the geometry of the lid 14, but it is clear to one skilled in the art that a clearance angle 94 greater than 90 degrees would likely be advantageous as it is likely that affords greater accessibility.

In some embodiments, clearance angle 94 is about the same or equal to connecting portion angle 105, particularly where top surface 108 (or middle portion top surface 79) is entirely coplanar and not stepped. The first portion 50 has varying wall thickness such that the outer edge thickness 51 of the movable member 48 is thin in comparison to an inner region thickness 52, middle region thickness 46, and/or lower region thickness 47. The outer edge thickness 51 is between about 0.5 mm and about 6 mm, or between about 1.0 mm to about 4.0 mm. In some embodiments, outer edge 49 has a geometry that is not completely complimentary to the geometry upper inner ledge.

In some embodiments, the cup or (container) 12 optionally has a cup insulating outer wall 118 that is optionally at least partially plastic or translucent. Where the cup insulating outer wall 118 is at least partially translucent, graphics are printed on the outer wall and/or the inner wall thereby creating depth therebetween. The cup or container assembly 10 is made from a variety of materials, including without limitation: plastic, silicone, films, rubber, thermoplastic elastomers (TPE), sealed wood, metal, composite materials, woven fiber materials, metals such as stainless steel, copper, aluminum, nickel, reconstituted or recycled materials, and/or bio-based materials such as sugarcane, blends of bio-based materials with plastic materials such as polypropylene, or any combination thereof. Preferably, the cup or container assembly 10 is made from material that provides sufficient rigidity in order to give it structure while providing sufficient flexibility so it can deflect under the user's hand or mouth to facilitate one or more user activated input features. Furthermore, the cup or container assembly 10 is sufficiently durable to repeated usage, cleaning, storage and optionally connection to other items.

In some embodiments, cup assembly 10, including the cup 12 and lid 14, are thermoplastic materials such as plastics, polypropylene, polyethylene, polyester, kostrate, silicone, TPE, rubber, latex, or other thermoplastic materials. Cup assembly 10 can also include other materials such as aluminum, stainless steel, glass, and wood. In embodiments having glass, a thermoplastic sleeve (that is attachable to or over-molded onto the glass) is advantageous to mitigate cracks upon dropping. In particular, the movable member 48 and/or the baffle 59 are made of a flexible material such as silicone, TPE, rubber, latex, or other thermoplastic materials.

In some embodiments, the cup assembly 10 includes injection molded parts. In some embodiments, the cup (or container) 12 is injection molded. Where the cup (or container) 12 includes lid connecting means 22 having bayonet and/or threaded connections, a threaded core cavity is used that is rotated outward from the cup (or container) 12 as if lid 14 were being disconnected from the cup (or container) 12. In other words, the threaded core cavity and cup (or container) 12 undergo relative rotational movement with respect to each other in order to release the cup (or container) 12 from the mold (including the threaded core cavity).

In some embodiments, the lid 14 is connectable to the cup 12 by a cup connecting means 61 that engage lid connecting means 22 on the cup 12. The cup connecting means 61 and lid connecting means 22 matingly engage by a friction fit, interference fit, detent, bayonet connecting means, or threads, or hybrids thereof, or other connecting means as described by the present disclosure.

Figure 11:
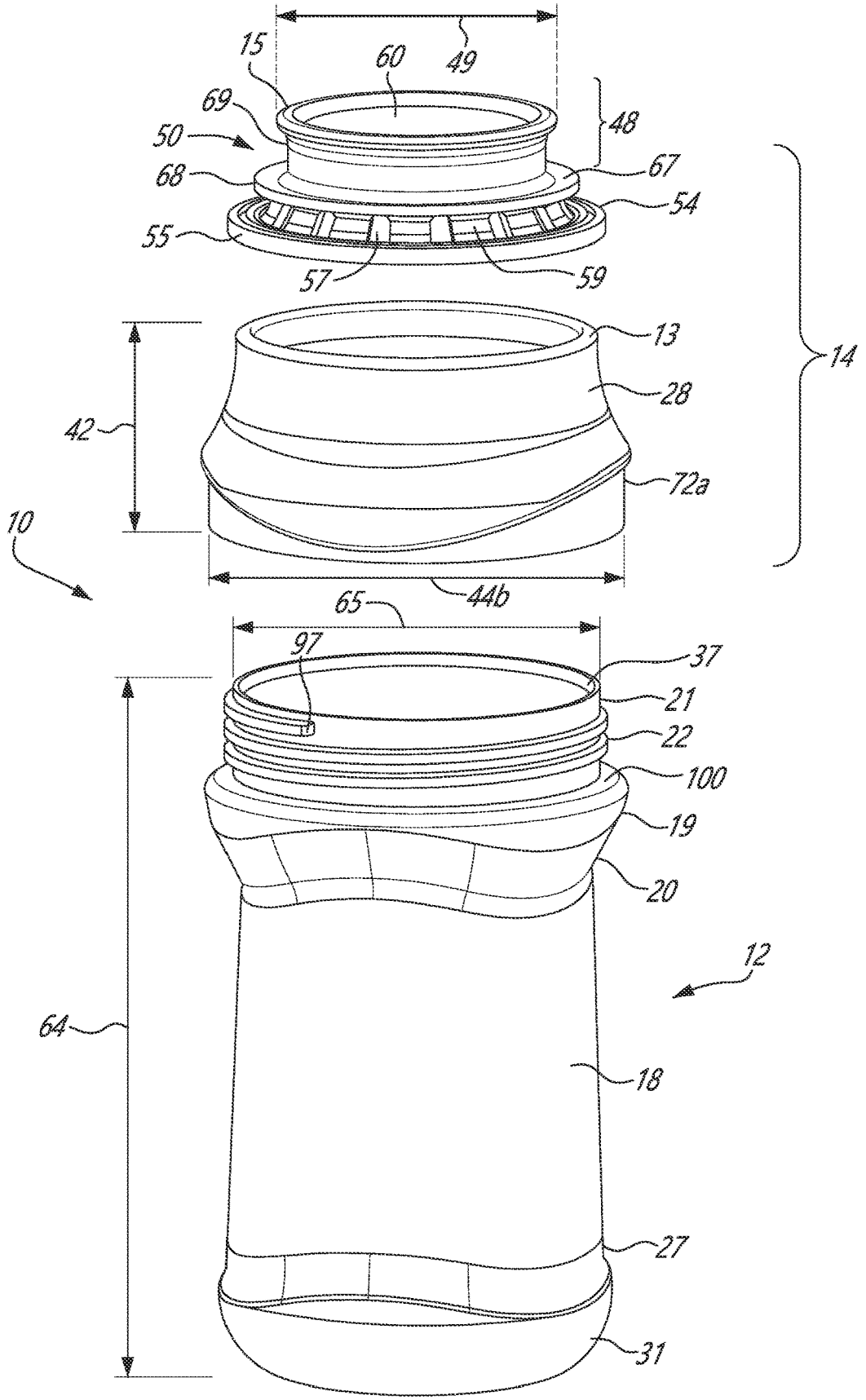
FIG. 11 is an exploded view of an embodiment of the present disclosure.
Figure 12:
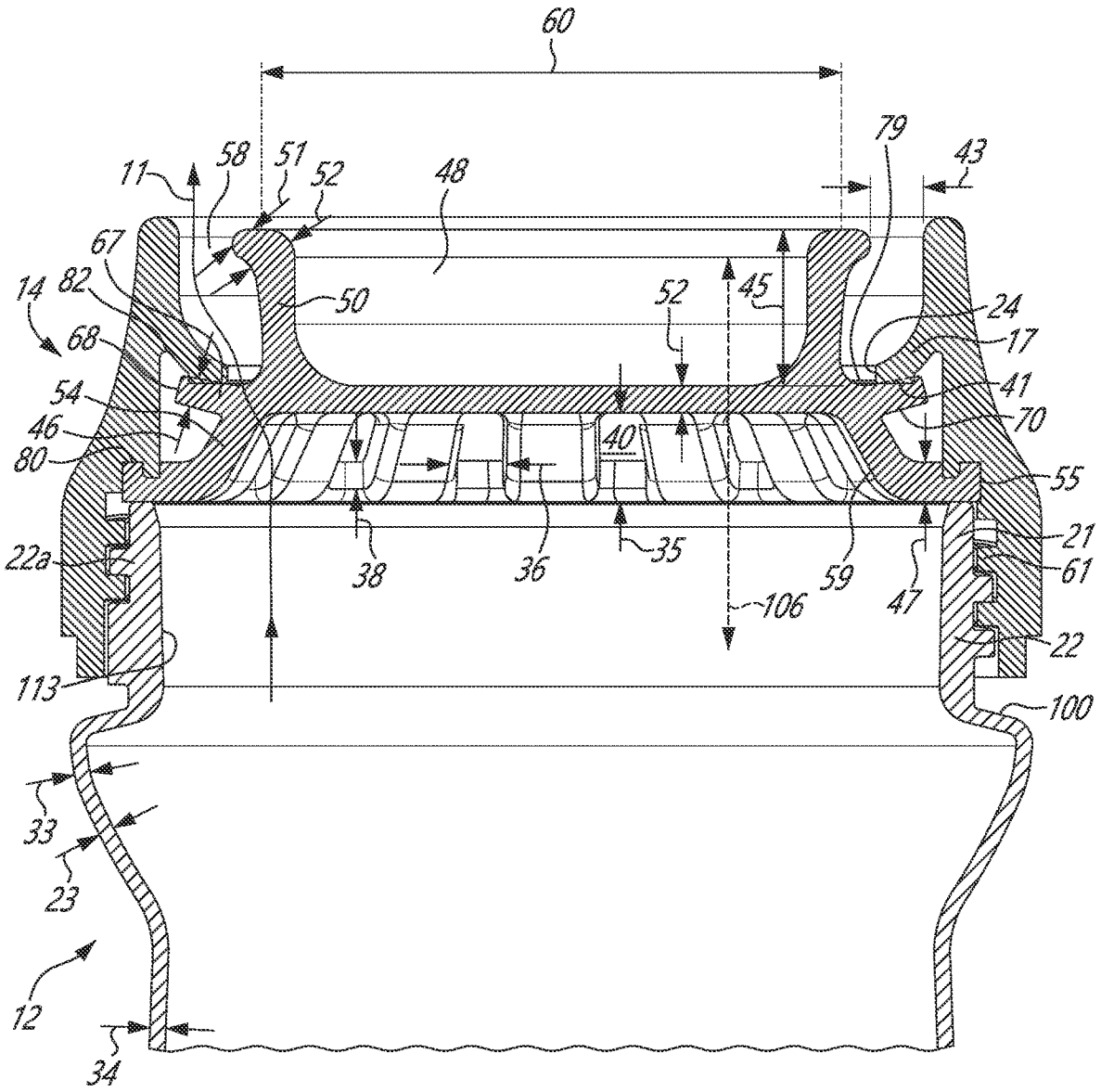
FIG. 12 is a detail cross-sectional view of an embodiment of the present disclosure.
Figure 14:
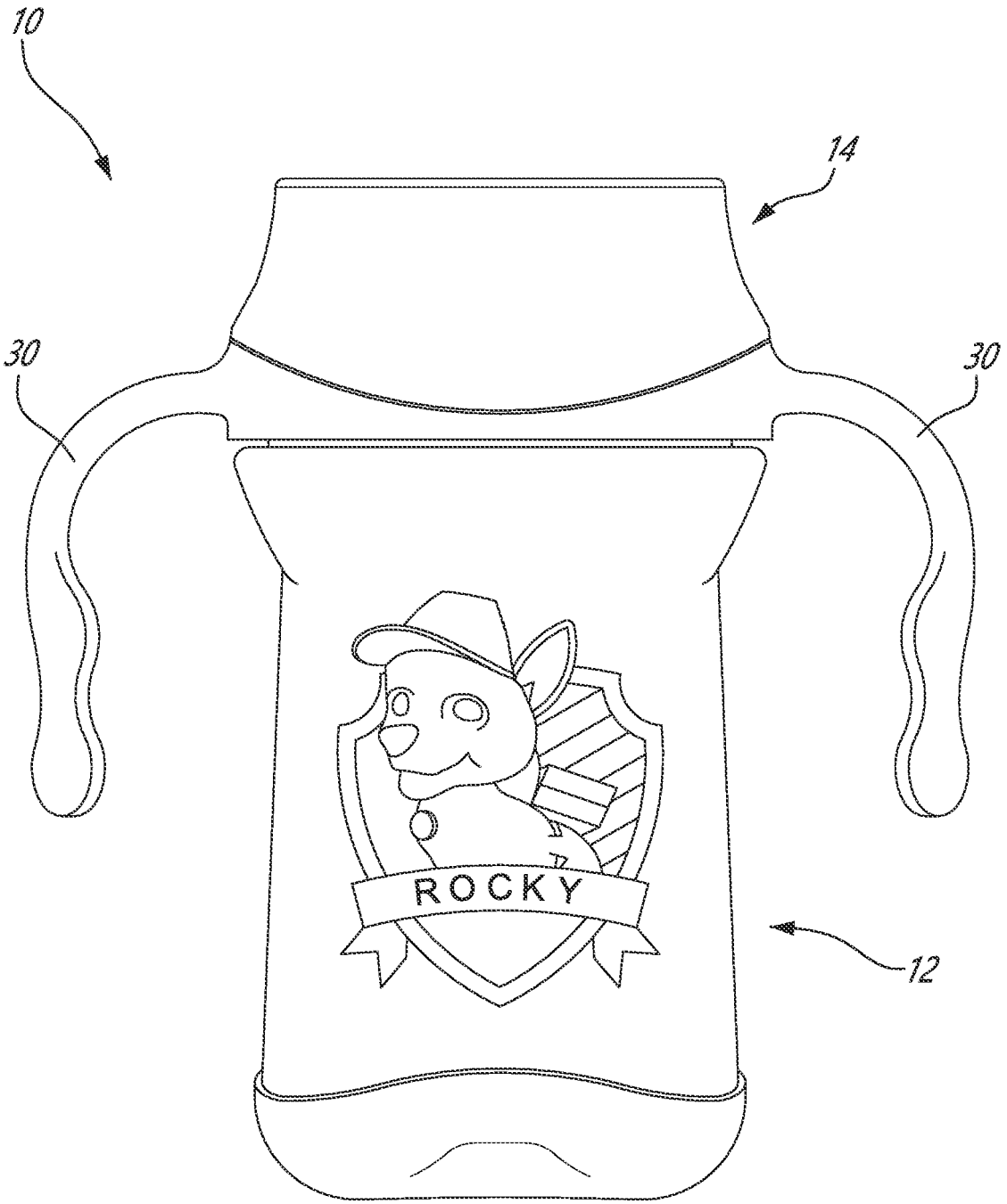
FIG. 14 is a front view of an embodiment of the present disclosure.

As shown in FIGS. 11, 12 and 14, lid connecting means 22 include one or more external threads located on the cup outer wall 114 on connecting wall 21. In some embodiments, there are between two and five continuous threads, or there are between two and five threads broken into one or more thread segments. The lid connecting means 22 are located below the lip 13 when the lid 14 is fully connected to the cup (or container) 12. The lid connecting means 22 is likewise located below outer lip 13 when the lid 14 is fully connected to the cup (or container) 12. The lid connecting means 22 has one or more threads 22*a* with each of the one or more threads having a leading end 97 and either a trailing end 98 or a thread stop 84. The cup connecting means 61 include one or more internal threads located on the lid inner wall 116 of collar 28. The cup connecting means 61 has one or more threads with each of the one or more threads having a leading end 97 and at trailing end 98. Optionally, the one or more trailing ends 98 terminates in either of a thread stop 84 or ledge 17. The cup connecting means 61 and lid connecting means 22 engage each other by relative rotational movement of one with respect to the other, such that the leading end(s) 97 engage each other until the one or more leading ends 97 on the cup connecting means 61 engage the one or more thread stops 84 on the lid connecting means 22 (and optionally, one or more leading ends 97 on lid connecting means 22 engages the one or more thread stops 84 or ledge 17 on collar 28). The cup (or container) 12 has cup connection indicator 96 and the lid 14 has lid connection indicator 99. Due to manufacturing tolerances for colorants, particularly during repeated usage and machine washing, cup connection indicator 96 and/or lid connection indicator 99 include a length showing a range of relative positions that are considered to be sufficiently closed and/or sealed. Optionally, lid 14 has recesses on either side of lid connection indicator 99 to make it more prominent and distinct from the rest of the lid 14.

The cup (or container) 12 has a cup connector 120. Cup connector 120 is one or more ribs, tabs, or detents, that extend upward from shoulder 100. Lid connector 122 is one or more ribs, tabs, or detents that extend downward from the lid 14 but such that the lowest end of the lid connector 122 is not significantly below the lowest perimeter of the lid 14 (such that the lid can rest on a surface without wobbling). Cup connector 120 and lid connector 122 can have free ends that are upward or downward, respectively, and on either side such that the free ends on the cup connector 120 are outward from the outer surface of the cup, and the free ends on the lid connecter 122 are either outward from the outer surface of the lid 14 and/or inward of the inner surface on the lid 14. As such, the cup connector 120 has to be sufficiently tall to engage lid connector 122 while not otherwise interfering with the lower perimeter of lid 14. Cup connector 120 is proximal cup connection indicator 96. The lid connector 122 is proximal the lid connection indicator 99. Additionally or alternatively, cup connector 120 is proximal the one or more trailing ends 98 or one or more thread stops 84 of the one or more threads 22*a* on the lid connecting means 22. Additionally or alternatively, the lid connector 122 is proximal the one or more leading ends 97 of threads on cup connecting means 61. In some embodiments, the cup connector 120 is proximal both the cup connection indicator 96 and the one or more thread stops 84 such that the cup connector 120 is engaged by lid connector 122 prior to engaging the one or more thread stops 84 and such that the lid connection indicator 99 is aligned with or rotates past cup connection indicator 96. Upon relative rotational movement that achieves a seal such that lid connector 122 passes over cup connector 120 such that the cup connection indicator 96 and lid connection indicator 99 demonstrate a sealed condition has been achieved (thereby mitigating against leaks if the cup assembly 10 is tipped-over), an audible and/or tactile indicator is provided in addition to the visual indication provided by cup connection indicator 96 and lid connection indicator 99.

One or more protrusions 81 are a detent or tab, or tab having a detent. The one or more protrusions 81 have a length, width, and/or depth of (extending radially outward (or inward) from central vertical axis 29) of about 1/32 (0.75 mm) of an inch to about 1/8 (3 mm) of an inch, and more preferably between about 1/32 and about 1/16 (1.5 mm) of an inch. In some embodiments, the one or more protrusions 81 extend outward and/or downward from the lower portion 54 outer periphery 55. Alternatively, the one or more recesses 82 and the one or more protrusions 81 can be positioned below the lid connecting means 22 and cup connecting means 61. Alternatively, the one or more recesses 82 can be positioned on the lid 14 proximal cup connecting means 61, while the one or more protrusions 81 are positioned on the connection wall 21 proximal the lid connecting means 61. As described above, this proximity enables the preferred location to be above the connecting means (22 and 61), or also below connecting means (22 and 61). While these embodiments having one or more protrusions 81 on the inner wall 113 would require an undercut during molding, it could be achieved with collapsible core tools permitting side action movement or via a rotational core where ledge 17 and any recesses 82 or protrusions are slightly angled and have thread-like or thread-segment-like qualities as described above. The relative rotational movement required to connect and disconnect the cup is substantially the same but in a reverse sequence. From a torque perspective, the total torque and/or highest torque required to fully-assemble the cup assembly 10 is optionally different from the total torque and/or highest torque required to disassembly the cup assembly 10. In some embodiments, the torque required to fully-assembly the cup assembly 10 is between about 10 in-lb to about 40 in-lb, and more preferably, between about 10 in-lb and about 30 in-lb. In some embodiments, the torque required to fully disassembly the cup assembly 10 is between about 10 in-lb and about 40 in-lb, and more preferably between about 15 in-lb and about 30 in-lb.

In some embodiments, the baffle 59 and movable member 48, or the first portion 50 and second portion 54, are unitary and not intended to be separable; this would include middle portion 67 for embodiments having middle portion 67. Such configuration requires a flexible material with sufficient rigidity to permit deflection without complete distortion of the movable member 48 and baffle 59 when a force is applied by a child.

Figure 3:
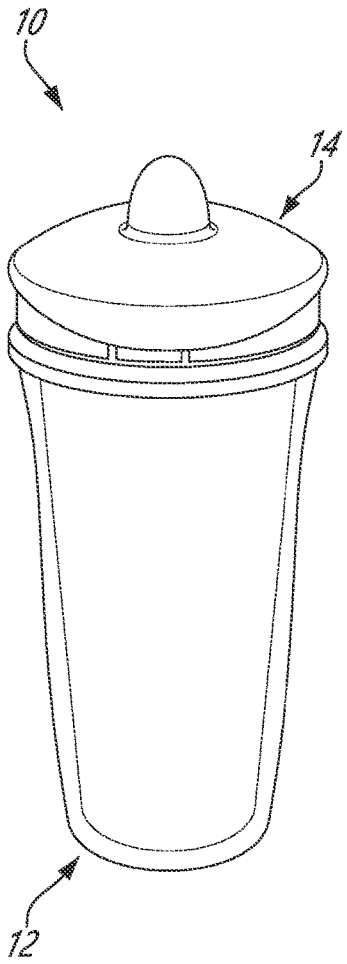
FIGS. 3-3*b* demonstrate an embodiment of the present disclosure having a variety of cups having interchangeable parts.
Figure 3A:
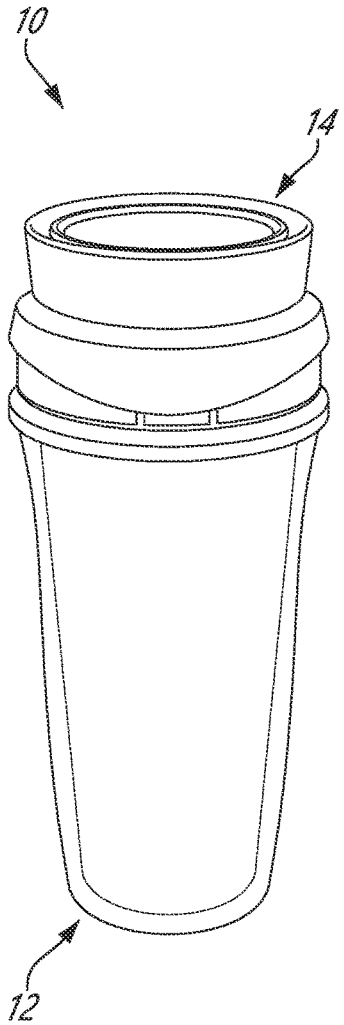
Figure 3B:
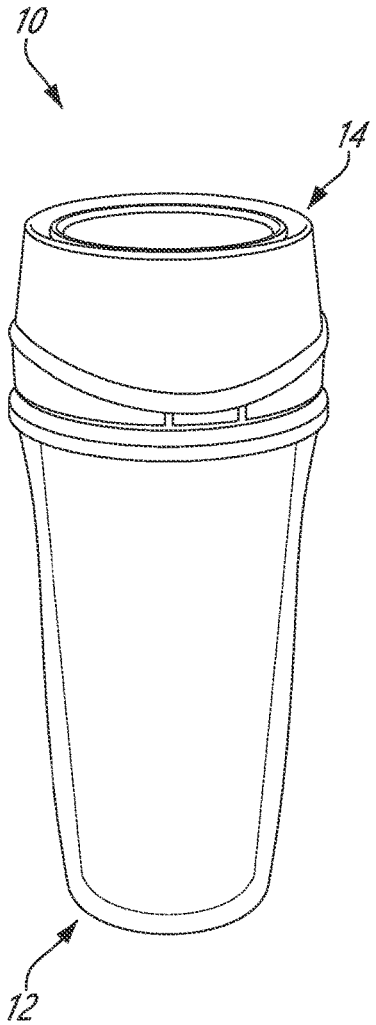
Figure 4:
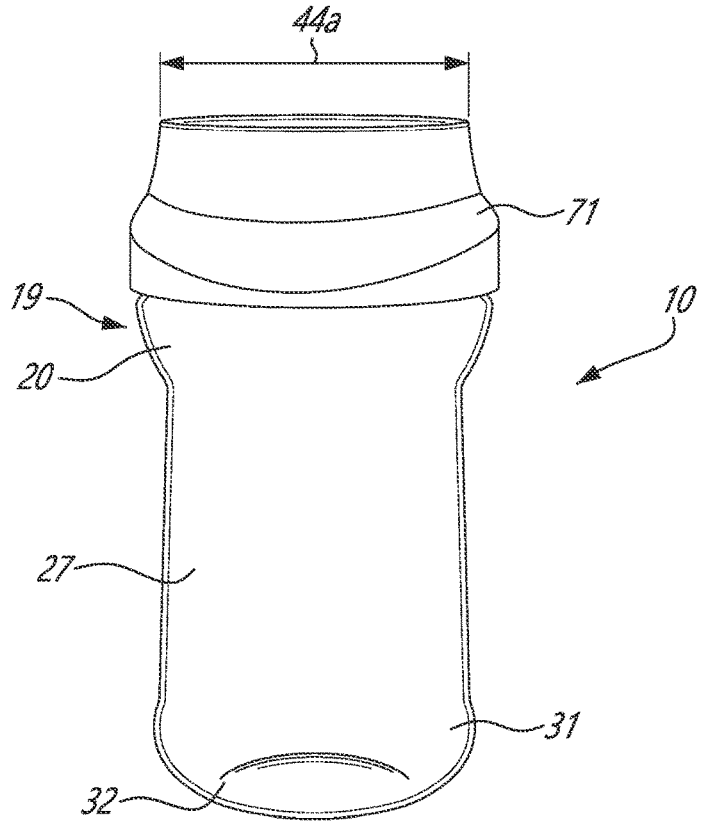
FIG. 4 is a front view of an embodiment of the present disclosure.
Figure 5:
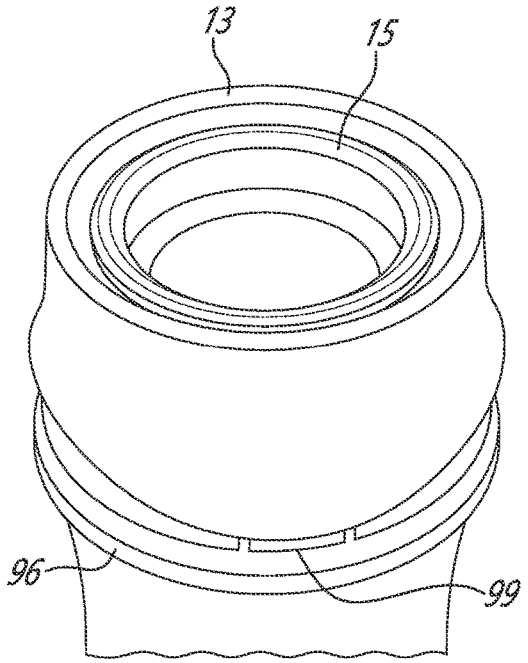
FIG. 5 is an angled top view of an embodiment of the present disclosure.
Figure 6:
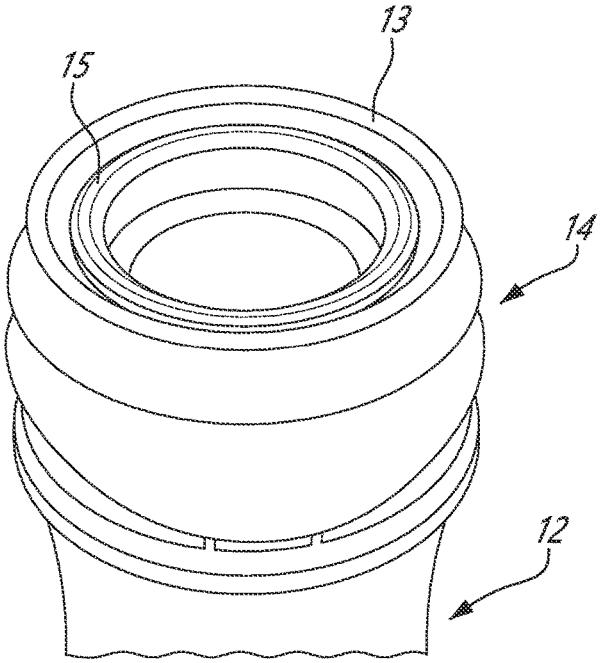
FIG. 6 is angled top view of an embodiment of the present disclosure.
Figure 7:
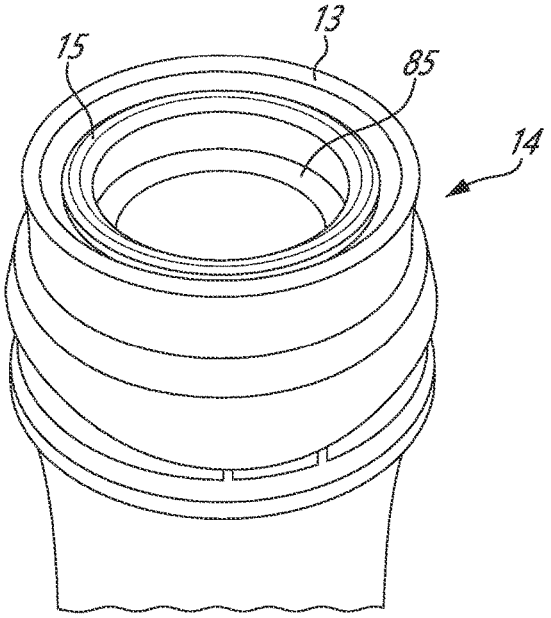
FIG. 7 is an angled top view of an embodiment of the present disclosure.

As exemplified in FIGS. 3-3*b*, a variety of lid 14 options are available to the user and/or caretaker that are compatible with the cup (or container) 12 of the present disclosure. FIG. 3 demonstrates a cup with a hard spout, but other cups with soft spouts and/or straws are also available and can be compatible. Compatibility is large-part due to the structure of the lid connecting means 22 and the cup connecting means, and also a function of ensuring cup diameter 65 and lid diameter 44*b* are the same as other cups with other lids. This reduces confusion with assembly of cups and lids and reduces the number of parts theoretically needed (i.e. having five different lid options and four cups those five lids matingly engage with). Furthermore, the user can have two or three different container or cup 12 options with only three or four total container assembly 10 components, as opposed to prior art cups that require a minimum of three or four components to function as a single cup.

As shown in FIG. 15, a cover 16 is provided for improved portability to ensure the movable member 48 is inadvertently deflected thereby causing fluid to flow out of the cup assembly 10 via fluid path 11. The cover is a snap-fit, friction-fit, or interference fit that mates to the outer lip 13 by having an outward and downward lip and also an inward and downward lip; the outward and inward lips mate to outer lip 13. The cover 16 has a cover height 42 of the cover 16 is between about 2 mm and about 60 mm, and more preferably between about 2 mm and about 20 mm, or up to about 15 mm.

The cup assembly 10 of the present disclosure can have a variety of purposeful configurations in order to please the child who is learning how to drink properly, and to also assist the caretaker in monitoring the amount of nourishment is within the cup or container 12. For example, the cup or container 12 may be fully or partially translucent, serving the purpose of enabling the caretaker to monitor the level of the contents in the cup or container 12 and also looking more akin to adult drinking vessels (likely causing the child to be proud of his/her accomplishment of using an adult-esque cup or container 12). The lid 14 is optionally fully or partially translucent for similar reasons, but also such that the child can see the contents of the cup or container 12 when it is being tipped in front of the child's face to access the contents therein. As the child seeks to establish the right amount of pressure or force to exert via his or her lips in order to allow fluid to pass between the outer lip 13 and the inner lip 15, seeing the water level move as the cup or container 12 is tipped helps to guide the child.

In further embodiments, the cup assembly 10 with a spill mitigating lid 14 has a theme. The cup 12 not only assists with assisting young children with learning how to drink, the lid/cup system functions in a unique and exceptional manner, much like a superhero and/or fictional character with supreme abilities. As such, the theme of such a cup assembly 10 can be akin to one or more superheroes, action heroes and/or other fictional character with impressive skills.

In some embodiments, the cup assembly 10 has a theme of being a "big kid" or a "grown-up". The cup assembly 10 is structured similarly to an adult drinking vessel such as an open rim cup. The top or lid 14 that mitigates against leaks is disposed about the upper end of the adult vessel, but the structure of the cup evokes sufficient similarity to the big kid or grown-up theme. In further embodiments, the cup assembly 10 has a secondary related theme such that a decoration, color, material and/or graphic resemble an adult drinking vessel.

It is to be understood that the above description is intended to be illustrative, and not restrictive. For example, the above-described embodiments (and/or aspects thereof) may be used in combination with each other. Many other embodiments will be apparent to those of skill in the art upon reviewing the above description. The scope of the invention should, therefore, be determined with reference to the appended claims, along with the full scope of equivalents to which such claims are entitled.

Where the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For instance, in some embodiments, the lid may include multiple components that are connected such that they do not require separation for cleaning. Additionally, in some embodiments, the lip of the cup is configured on a removable lid assembly, such that the lid is attachable to the cup as a lid or collar, where the lid is one or more parts that do not require separation for cleaning. Therefore, it is intended that the present disclosure not be limited to the particular embodiment(s) disclosed herein as the best mode contemplated for carrying out this present disclosure.

Throughout the present disclosure, the terms "a" or "an" are used, as is common in patent documents, to include one or more than one. In this document, the term "or" is used to refer to a nonexclusive or, unless otherwise indicated. In the appended claims, the terms "including" and "in which" are used as the plain-English equivalents of the respective terms "comprising" and "wherein." Moreover, in the following claims, the terms "first," "second," and "third," etc., as they may be included, are used merely as labels, and are not intended to impose numerical requirements on their objects. In the Detailed Description provided above, various features may be grouped together to streamline the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separate embodiment.

What is claimed is:

1. A lip-activated cup assembly, comprising:

a cup having a cup body defining a cup volume, the cup body having a lid connecting means in an upper portion thereof;

a lid assembly connectable to the upper portion of the cup body, the lid assembly including:

a collar having an outer lip extending peripherally at an upper end thereof, the collar having cup connecting means engageable with the lid connecting means to removably secure the collar to the cup body;

a movable member received within the collar, the movable member defining an inner lip at an upper end thereof, the inner lip extending peripherally, radially inward from the outer lip of the collar, the inner lip and the outer lip defining an annular gap therebetween, the inner lip deflectable so as to move between a deflected position and a rest position to vary a gap width between the inner lip and outer lip; and a baffle received within the collar, the baffle connected to the movable member on a side of the movable member opposite that of the inner lip, the baffle having one or more openings that are radially inward of an outer periphery of the baffle, the one or more openings in fluid flow communication with the annular gap upon deflecting the inner lip to the deflected position, the baffle having one or more protrusions located on the outer periphery thereof, the one or more protrusions engaging the cup connecting means thereby maintaining the lid assembly in a single unit.

2. The lip-activated cup assembly according to claim 1, wherein the collar has a ledge extending inwardly from an inner wall of the collar and the movable member including a portion engaging the ledge in the rest position, thereby creating a seal in the rest position.

3. The lip-activated cup assembly according to claim 2, wherein upon deflecting the inner lip, the portion of the movable member disengage from a lower surface of the ledge.

4. The lip-activated cup assembly according to claim 2, wherein the ledge has a ledge inner perimeter that is larger than an outer perimeter of the inner lip.

5. The lip-activated cup assembly according to claim 1, wherein the baffle and the movable member are mechanically fastened, wherein the baffle has a movable member connecting means on a baffle top surface and the movable member has a baffle connecting means on a lower surface of the movable member, wherein one of the movable member connecting means and the baffle connecting means is a male member and the other of the movable member connecting means and the baffle connecting means is a female member.

6. The lip-activated cup assembly according to claim 5, wherein the baffle and the movable member can be disengaged by a force less than or equal to 5 lb-in.

7. The lip-activated cup assembly according to claim 1, wherein the baffle and the movable member are connected by a press-fit, friction-fit, and/or interference fit.

8. The lip-activated cup assembly according to claim 1, wherein the cup connecting means include one or more threads or thread segments.

9. The lip-activated cup assembly according to claim 8, wherein the one or more protrusions engage at least a portion of the one or more threads or thread segments such that the one or more protrusions interfere with at least a portion of the one or more threads or thread segments.

10. The lip-activated cup assembly according to claim 1, wherein the movable member is made of a flexible material including a thermoplastic material.

11. The lip-activated cup assembly according to claim 1, wherein the movable member is made of a flexible material including silicone, thermoplastic elastomer (TPE), rubber or latex.

12. The lip-activated cup assembly according to claim 1, wherein the cup body has a thickness that vary along the cup body, such that an upper wall thickness of the cup body has a greater thickness than at least some portion of a lower wall thickness of the cup body.

13. The lip-activated cup assembly according to claim 1, further comprising one or more handles removably connected to the collar.

14. The lip-activated cup assembly according to claim 13, wherein the one or more handles and the collar are connectable via alignment features, the alignment features include keying features on the one or more handles and the collar.

15. The lip-activated cup assembly according to claim 1, further comprising a cover matingly engageable with the outer lip in a snap-fit, friction-fit or interference fit.

16. The lip activated cup assembly according to claim 1, wherein the baffle and the movable member are integral or chemically fastened.

* * * * *